US011486684B1

(12) United States Patent
Kinney et al.

(10) Patent No.: US 11,486,684 B1
(45) Date of Patent: Nov. 1, 2022

(54) DISPENSER FOR FIREARM AMMUNITION POWDER

(71) Applicant: AOB Products Company, Columbia, MO (US)

(72) Inventors: Tim Kinney, Warrenton, MO (US); James Tayon, Moberly, MO (US); Mike Cottrell, Ashland, MO (US); Dennis Cauley, Fayette, MO (US); Justin Burke, Columbia, MO (US); Brian Steere, Columbia, MO (US); Kyle Martin, Columbia, MO (US); Anthony Vesich, Columbia, MO (US); Michael Poehlman, Columbia, MO (US); James Gianladis, Harrisburg, MO (US); Matthew Kinamore, Columbia, MO (US); Joel Yuodsnukis, Columbia, MO (US); Jeff Talbott, Florissant, MO (US); Mark Dalton, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 17/713,385

(22) Filed: Apr. 5, 2022

Related U.S. Application Data

(63) Continuation of application No. 17/445,068, filed on Aug. 13, 2021, which is a continuation of application (Continued)

(51) Int. Cl.
*F42B 33/02* (2006.01)

(52) U.S. Cl.
CPC ..... *F42B 33/0285* (2013.01); *F42B 33/0207* (2013.01); *F42B 33/02* (2013.01); *F42B 33/0292* (2013.01)

(58) Field of Classification Search
CPC .. F42B 33/0285; F42B 33/0207; F42B 33/02; F42B 33/0292

(Continued)

(56) References Cited

U.S. PATENT DOCUMENTS 3,014,400 A 12/1961 Smith
4,629,093 A 12/1986 Le Molaire (Continued)

OTHER PUBLICATIONS

Batchelor T.C., U.S. Pat. No. 542,322 patented on Jul. 9, 1895, 5 pages.

(Continued)

*Primary Examiner* — Joshua E Freeman
(74) *Attorney, Agent, or Firm* — Stinson LLP

(57) ABSTRACT

A dispenser for dispensing powder for firearm ammunition and associated methods. The dispenser can include a hopper, a conveyor, a scale, a dispenser controller, and a tangible storage medium storing instructions executable by the dispenser controller. The dispenser controller can execute a powder calibration sequence and/or a dispensing sequence. In the powder calibration sequence and/or the dispensing sequence, the dispenser controller desirably learns the dispense rate of the powder and uses the dispense rate to optimize dispensing of the powder and increase precision in dispensing a target mass of powder. The conveyor can comprise a conveyor tube having a conveyor tube axis oriented to extend at an upward angle with respect to horizontal.

14 Claims, 14 Drawing Sheets

Related U.S. Application Data

No. 16/107,486, filed on Aug. 21, 2018, now Pat. No. 11,118,884.

(58) Field of Classification Search
USPC ..... 86/31
See application file for complete search history.

(56) References Cited

U.S. PATENT DOCUMENTS

| | | | | |
|---|---|---|---|---|
| 4,696,356 | A | 9/1987 | Ellion et al. | |
| 4,733,594 | A | 3/1988 | Bajohr | |
| 4,850,259 | A | 7/1989 | Morris | |
| 5,052,549 | A | 10/1991 | Scharch | |
| 6,057,515 | A | 5/2000 | Murai et al. | |
| 6,121,556 | A | 9/2000 | Cole | |
| 6,722,403 | B2 | 4/2004 | Zhou et al. | |
| 6,981,619 | B2 | 1/2006 | Moretto | |
| 7,614,429 | B2 | 11/2009 | Pluvinage et al. | |
| 7,694,589 | B2 | 4/2010 | Mehus et al. | |
| 7,954,668 | B2 | 6/2011 | Mehus et al. | |
| 7,958,916 | B2 | 6/2011 | Poole et al. | |
| 8,118,068 | B2 | 2/2012 | Pluvinage et al. | |
| 8,230,887 | B2 | 7/2012 | Poole et al. | |
| 8,257,523 | B1 | 9/2012 | Puszynski et al. | |
| 8,783,509 | B2 | 7/2014 | Nordlund | |
| 8,803,009 | B2 | 8/2014 | Poole et al. | |
| 9,151,583 | B1 * | 10/2015 | Stark | F42B 33/004 |
| 9,562,803 | B2 | 2/2017 | Carter et al. | |
| 9,599,442 | B2 | 3/2017 | Pearlson | |
| 9,726,467 | B1 | 8/2017 | Scott | |
| 9,772,216 | B2 | 9/2017 | Poole et al. | |
| 9,829,295 | B2 | 11/2017 | Todd | |
| 10,012,484 | B2 | 7/2018 | Pearlson | |
| 10,352,671 | B1 | 7/2019 | Freeman et al. | |
| 10,563,966 | B2 * | 2/2020 | Haberman | F42B 33/0285 |
| 10,620,034 | B2 | 4/2020 | Poole et al. | |
| 10,697,746 | B2 | 6/2020 | Lutz | |
| 10,852,105 | B1 | 12/2020 | Xiaowen et al. | |
| 2005/0280185 | A1 | 12/2005 | Russell et al. | |
| 2006/0169263 | A1 | 8/2006 | Boys | |
| 2007/0131707 | A1 | 6/2007 | Poole et al. | |
| 2012/0204707 | A1 | 8/2012 | Park et al. | |
| 2013/0206913 | A1 | 8/2013 | Stevenson | |
| 2013/0284520 | A1 | 10/2013 | Carter et al. | |
| 2015/0053071 | A1 | 2/2015 | Holland | |
| 2015/0246769 | A1 * | 9/2015 | Pearlson | F42B 33/0207 414/21 |
| 2016/0313103 | A1 | 10/2016 | Bergmann | |
| 2017/0121039 | A1 | 5/2017 | Ciesiun | |
| 2017/0217693 | A1 | 8/2017 | Pearlson | |
| 2017/0219326 | A1 * | 8/2017 | Todd | F42B 33/0292 |
| 2019/0063890 | A1 | 2/2019 | Abel | |
| 2019/0145746 | A1 | 5/2019 | Haberman | |
| 2019/0339049 | A1 | 11/2019 | Rastegar | |
| 2019/0368848 | A1 | 12/2019 | Carter et al. | |
| 2020/0011644 | A1 * | 1/2020 | Hemeyer | G01G 13/02 |
| 2020/0033105 | A1 * | 1/2020 | Hemeyer | F42B 33/0292 |
| 2020/0049475 | A1 | 2/2020 | Hilko et al. | |
| 2020/0064114 | A1 * | 2/2020 | Kinney | F42B 33/0207 |
| 2020/0094478 | A1 | 3/2020 | Zediker et al. | |
| 2020/0103210 | A1 | 4/2020 | Sparling | |
| 2020/0262147 | A1 | 8/2020 | Mamrak et al. | |
| 2020/0363180 | A1 | 11/2020 | Townsend | |
| 2020/0393228 | A1 | 12/2020 | Burke et al. | |
| 2021/0094102 | A1 | 4/2021 | Lin et al. | |
| 2021/0114285 | A1 | 4/2021 | Tibbits et al. | |

OTHER PUBLICATIONS

Lyman Gen 6 Compact Touch-Screen Powder System, www.lymanproducts.com, Dec. 2012, 10 pages.

Owner's Manual, Lock-N-Load Auto Charge, www.hornady.com, Dec. 2014, 8 pages.

RCBS Chargemaster Lite Instruction Manual, Product Instructions, www.rcbs.com, (2017) 64 pages.

MacDonald, Adam, Automatic Powder Trickler (Version 2)—Instructions for Setup and Use (Jan. 2017), 3 pages.

MacDonald, Adam, AutoTrickler (Version 3) User Manual (Jun. 2019), 20 pages.

MacDonald, Adam, AutoTrickler (Version 4) User Manual (Oct. 2021), 24 pages.

AutoTrickler, How to Tune the Autotrickler, YouTube video located at https://www.youtube.com/watch?v=L7pFZkKeNhc, May 4, 2017, 1 page.

AutoTrickler, AutoThrow Upgrade for AutoTrickler V2!, YouTube video located at https://www.youtube.com/watch?v=EZ6RuUxugiw, Jun. 23, 2017, 1 page.

Gavintoobe, New: AutoTrickler V3 Powder Dispensing System (full details), YouTube video located at https://www.youtube.com/watch?v=c54nuMXU3Qo, May 23, 2019, 1 page.

Aaron Hipp, Gen 2 Prometheus, YouTube video located at https://youtu.be/JPH8suKaHFs, Oct. 11, 2014, 1 page.

Primalrights, Prometheus Powder Measure—Instructional Video, YouTube video located at https://youtu.be/0E1PKdPbME0, Jan. 26, 2016, 1 page.

* cited by examiner

DISPENSER FOR FIREARM AMMUNITION POWDER

CROSS-REFERENCE TO RELATED APPLICATION

This application claims priority to U.S. application Ser. No. 17/445,068, filed Aug. 13, 2021, and U.S. application Ser. No. 16/107,486, filed Aug. 21, 2018, now U.S. Pat. No. 11,118,884, the entireties of which are hereby incorporated by reference.

FIELD

The present disclosure generally relates to dispensing apparatus, and more particularly to a dispenser for dispensing powder for firearm ammunition.

BACKGROUND

Persons manufacturing or reloading firearm ammunition often use electronic powder dispensers to dispense portions of powder to be used as a propellant in a round of ammunition. Such electronic powder dispensers are typically used to dispense a certain amount of powder to a tray, and the powder is then poured into a case or shell for making the round of ammunition. Usually, the powder dispensers are used to dispense a plurality of loads of powder, one after another, for loading many rounds of ammunition. Common electronic powder dispensers suffer from various disadvantages. For example, some electronic powder dispensers dispense powder relatively slowly to avoid overshooting the desired final mass of powder. Slow operation can cause user dissatisfaction due to the overall length of time required to dispense powder for multiple rounds of ammunition. Some electronic powder dispensers do not reliably dispense exactly the target mass of powder, which also causes user dissatisfaction.

SUMMARY

In one aspect, a dispenser for dispensing powder for firearm ammunition includes a base configured to rest on a support surface. The dispenser includes a scale supported by the base. The scale includes a powder support and a scale sensor. The scale sensor is positioned and configured to generate a scale signal in response to powder supported by the powder support. A hopper is supported by the base and configured to hold a supply of powder. A conveyor is supported by the base and arranged to dispense powder from the hopper to the scale. A powder dispenser controller is configured to receive the scale signal. The powder dispenser controller is operable to control the conveyor to dispense powder to the scale. A tangible storage medium stores powder dispenser controller executable dispensing instructions that, when executed by the powder dispenser controller: run the conveyor at a conveyor speed to dispense powder for a dispensing cycle; during the dispensing cycle while the conveyor is dispensing powder, determine an actual dispense rate of powder dispensed to the scale during the dispensing cycle based on the scale signal; based on the actual dispense rate of the powder dispensed to the scale during the dispensing cycle, change the conveyor speed during the dispensing cycle or change a dispensing cycle run end time at which the conveyor is to be stopped for ending the dispensing cycle, and stop running the conveyor at the dispensing cycle run end time.

In another aspect, a dispenser for dispensing powder for firearm ammunition includes a base configured to rest on a support surface. The dispenser includes a scale supported by the base. The scale includes a powder support and a scale sensor. The scale sensor is positioned and configured to generate a scale signal in response to powder supported by the powder support. A hopper is supported by the base and configured to hold a supply of powder. A conveyor is supported by the base and arranged to dispense powder from the hopper to the scale. A user interface is adapted to receive user input representative of a target mass of powder to be dispensed to the scale and to generate a target mass signal based on the received user input. A powder dispenser controller is configured to receive the scale signal and the target mass signal, the powder dispenser controller operable to control the conveyor to dispense powder to the scale. A tangible storage medium stores powder dispenser controller executable calibration instructions that, when executed by the powder dispenser controller: run the conveyor at a conveyor speed to dispense powder to the scale for a powder calibration cycle; determine a dispense rate at which powder was dispensed to the scale during the powder calibration cycle; after the powder calibration cycle, run the conveyor at the conveyor speed for a dispensing cycle; and stop running the conveyor to end the dispensing cycle at a dispensing cycle run end time that is based on the dispense rate and the target mass signal.

In another aspect, a dispenser for dispensing powder for firearm ammunition includes a base configured to rest on a support surface. The dispenser includes a scale supported by the base. The scale includes a powder support and a scale sensor. The scale sensor is positioned and configured to generate a scale signal in response to powder supported by the powder support. A hopper is supported by the base and configured to hold a supply of powder. A conveyor is supported by the base and arranged to dispense powder from the hopper to the scale. A powder dispenser controller is configured to receive the scale signal. The powder dispenser controller is operable to control the conveyor to dispense powder from the hopper to the scale. A tangible storage medium stores powder dispenser controller executable instructions that, when executed by the powder dispenser controller: run the conveyor to dispense a first amount of powder to the scale; determine a dispense rate at which the first amount of powder was dispensed to the scale; and after dispensing the first amount of powder to the scale, run the conveyor, at a conveyor speed based on said determined dispense rate or until a dispensing cycle run end time based on said determined dispense rate, to dispense a second amount of powder to the scale.

In yet another aspect, a dispenser for dispensing powder for firearm ammunition includes a base configured to rest on a horizontal support surface. The dispenser includes a scale supported by the base. A hopper supported by the base is configured to hold a supply of powder. A conveyor tube supported by the base is rotatable about a conveyor tube axis to dispense powder from the hopper to the scale. The conveyor tube is arranged with respect to the base such that the conveyor tube axis extends distally from the hopper at an upward angle when the base is resting on the horizontal support surface.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
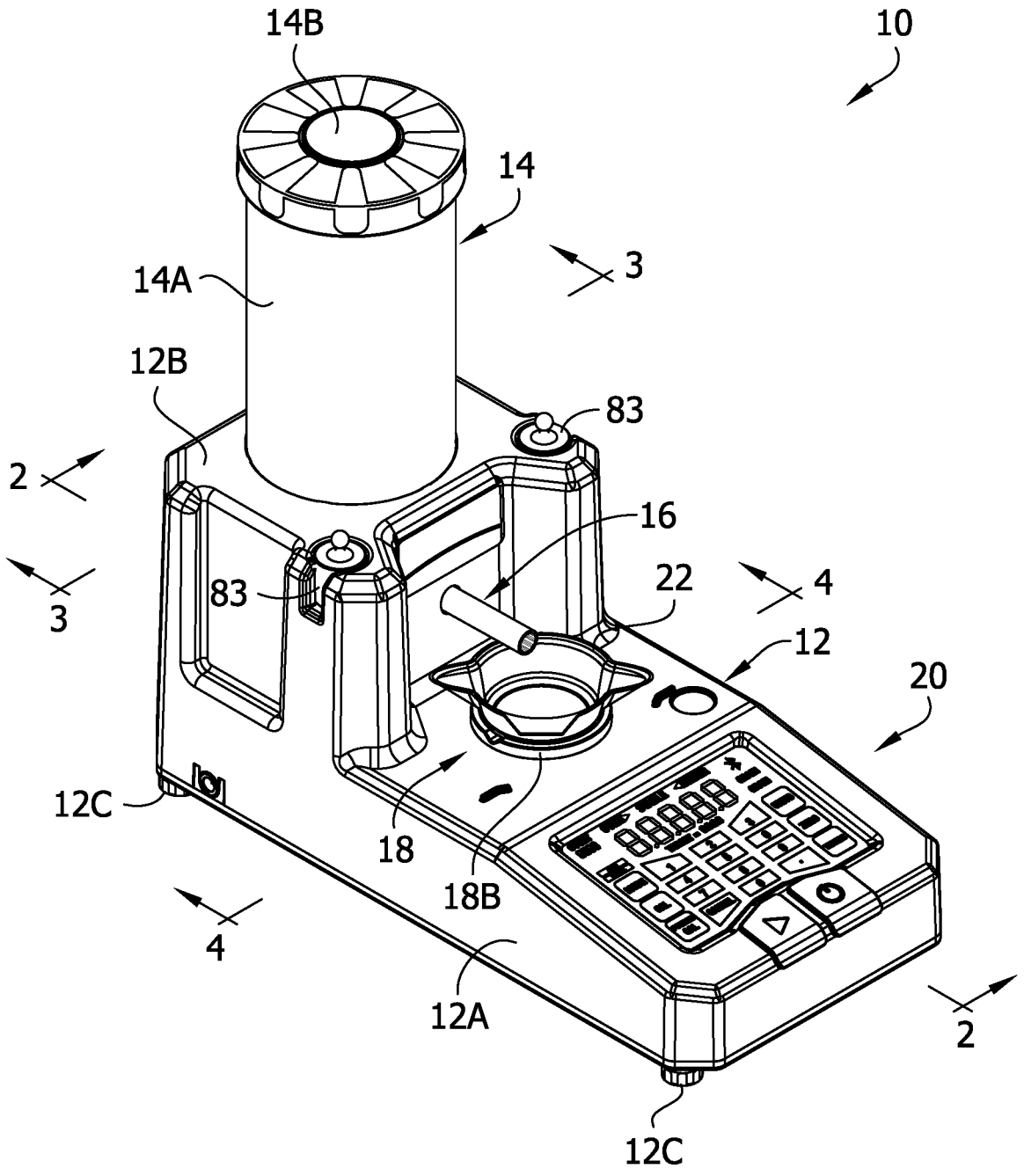
FIG. 1 is a perspective of a powder dispenser of the present disclosure.

Referring to FIGS. 1-6, a powder dispenser of the present disclosure is designated generally by the reference number 10. The dispenser 10 is configured to dispense precise amounts of powder (e.g., gun powder or propellant powder) for use in ammunition loading or other purposes. In general, the dispenser 10 includes a housing 12, a hopper 14, a conveyor 16, a scale 18, and a user interface 20. The hopper 14 is configured to hold a supply of powder to be dispensed in numerous discharges of powder of precise quantity. The conveyor 16 is arranged to receive powder from the hopper 14 and to dispense the powder to the scale 18. The scale measures the amount of powder supported by the scale. A tray 22 or other container can be supported by the scale 18 for receiving and containing the dispensed amount of powder. The user interface 20 is configured to receive user input and to display information associated with the powder dispenser 10, such as a target amount of powder to be dispensed and/or a mass of powder currently supported by the scale. Components of the dispenser 10 can be made of plastic, metal, and/or other suitable materials.

In one example, the dispenser 10 may be used to dispense a small amount of powder for use in a single round of ammunition. The dispenser 10 can be operated repeatedly to dispense the same amount of powder for use in manufacturing or reloading several rounds of ammunition of the same type. For safety and accuracy when shooting the rounds, it is important that the amounts of powder be precisely measured and be consistent from round to round for a given type of ammunition. Powder dispensing is complicated by the fact that different types of powders have different flow characteristics caused by attributes such as shape and size of the granules of the powder. Common types of powders include extruded, flake, and ball powders. Ball powder flows relatively freely, and flake powder may flow as freely as ball powder. Extruded powder usually flows less freely compared to ball and flake powder. Dispense rate of the powder can also vary based on the amount of powder in the hopper 14 (more powder, more down pressure) and the moisture content of the powder. The amount of powder dispensed can exceed the desired amount if the powder flows more quickly than expected, especially when a fast conveyor speed is used.

The dispenser 10 is constructed to enable a user to dispense powder quickly and in precise amounts notwithstanding the type of powder being dispensed and notwithstanding other factors such as the amount of powder in the hopper 14 or the moisture content of the powder. The dispenser 10 automatically adapts to powders having different flow characteristics to optimize the dispensing process. For example, as explained in further detail below, in a calibration mode and/or in a dispensing mode, the dispenser 10 can learn the dispense rate of a powder and use the learned dispense rate to set a time to stop running the conveyor 16 when a certain amount of powder is predicted to have been dispensed. When operating the conveyor 16 at fast speeds, if the conveyor were stopped when the scale 18 indicates the desired amount of powder has been dispensed, over dispensing would likely result due to lag in scale feedback, inertia of the conveyor, and/or flow characteristics of the powder. The ability of the dispenser 10 to automatically and dynamically adjust in real time based on the learned dispense rate of the powder enables the dispenser to more reliably dispense precise amounts of powder with the conveyor 16 operating at a relatively fast speed, leading to increased user satisfaction.

Figure 2:
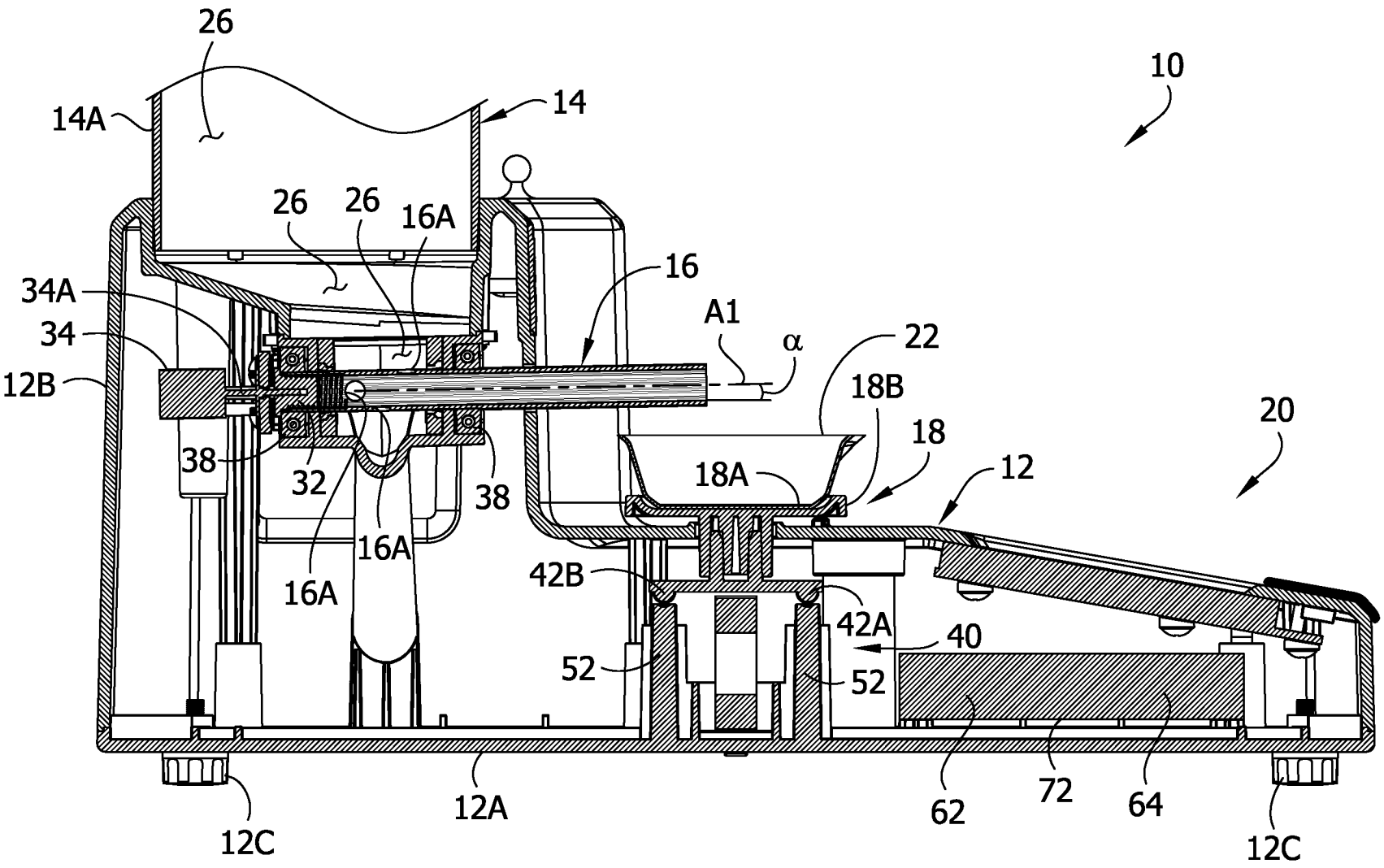
FIG. 2 is a section of the powder dispenser taken in a plane including line 2-2 of FIG. 1.

Referring now to FIGS. 1 and 2, the dispenser housing 12 includes a base 12A and an upper portion 12B extending upward from the base. The base 12A includes four feet 12C positioned for engagement with a support surface such as a table top or bench top. The feet 12C are adjustable in height for leveling the scale 18 in a horizontal orientation such that an upper face 18A of a scale platform 18B (broadly, a powder support) is horizontal. The housing 12 is constructed to house various electronic components of the dispenser 10 and supports the hopper 14, conveyor 16, scale 18, and user interface 20. Other types of housings can be used without departing from the scope of the present invention.

Figure 3:
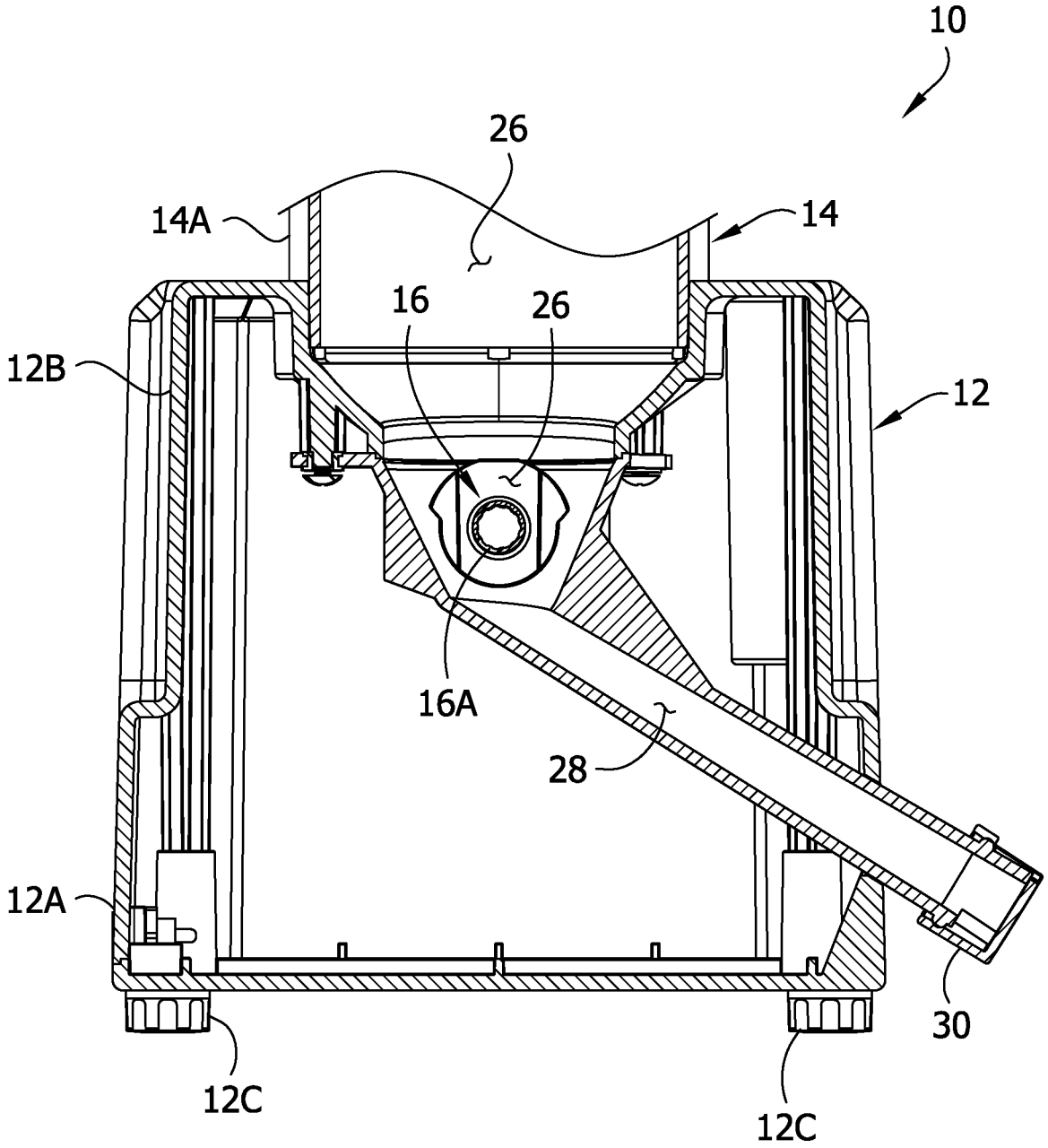
FIG. 3 is a fragmentary section of the powder dispenser taken in a plane including line 3-3 of FIG. 1.

The hopper 14 includes a generally cylindrical container 14A having a lid 14B. The lid 14B can be removed from the container 14A for loading powder in the hopper 14. The container 14A is received in a well in the upper portion 12B of the housing 12. The container 14A has an interior that together with the well of the upper portion 12B of the housing 12 forms a powder compartment 26 for receiving and holding powder. Thus, in the illustrated embodiment, the hopper 14 is formed by not only the cylindrical container 14A but also the upper portion 12B of the housing 12. As shown in FIGS. 2 and 3, the well in the housing 12 is tapered to provide a relatively narrow lower end of the powder compartment 26. The bottom end of the powder compartment 26 is open to a chute 28 for emptying powder from the hopper 14. A bottom end of the chute 28 is normally closed by a cap 30 and can be opened to permit powder to flow out of the chute for emptying the hopper 14.

In the illustrated embodiment, the conveyor 16 comprises a conveyor tube extending through the lower end of the powder compartment 26 for receiving powder from the powder compartment and conveying the powder to the scale 18. The conveyor tube 16 has a proximal end receiving a fitting 32 that connects the conveyor tube to a motor 34. For example, the motor can be a 12 volt motor. The motor 34 is supported by the housing 12 and has a motor shaft 34A received in and conjointly rotatable with the fitting 32. The conveyor tube 16 extends through two bearings 38 supported by the housing 12 to support the conveyor tube for rotation about a conveyor tube axis A1. A portion of the conveyor tube 16 between the two bearings 38 is exposed in the powder compartment 26 and has a plurality of openings 16A (e.g., three openings) for powder to enter the interior of the conveyor tube. The conveyor tube 16 can be rotated by the motor 34 about the conveyor tube axis A1 to receive powder through the openings 16A, to convey powder distally along the interior of the tube, and to dispense powder from a distal open end of the tube. The illustrated conveyor tube 16 has internal grooves and ridges extending along the length of the tube parallel to the axis A1 to promote conveyance of powder along the tube as the tube is rotated. However, the inside of the tube can be smooth walled or have other flow features (e.g., helical rifling) without departing from the scope of the present invention. The motor 34 is operable at different speeds to run the conveyor 16 at different speeds (e.g., measured by rotations per second or radians per second about the conveyor axis). The conveyor speed can also be referenced in terms of a duty cycle of the motor 34. Other types of conveyors and systems for moving the conveyor 16 can be used without departing from the scope of the present invention.

Figure 4:
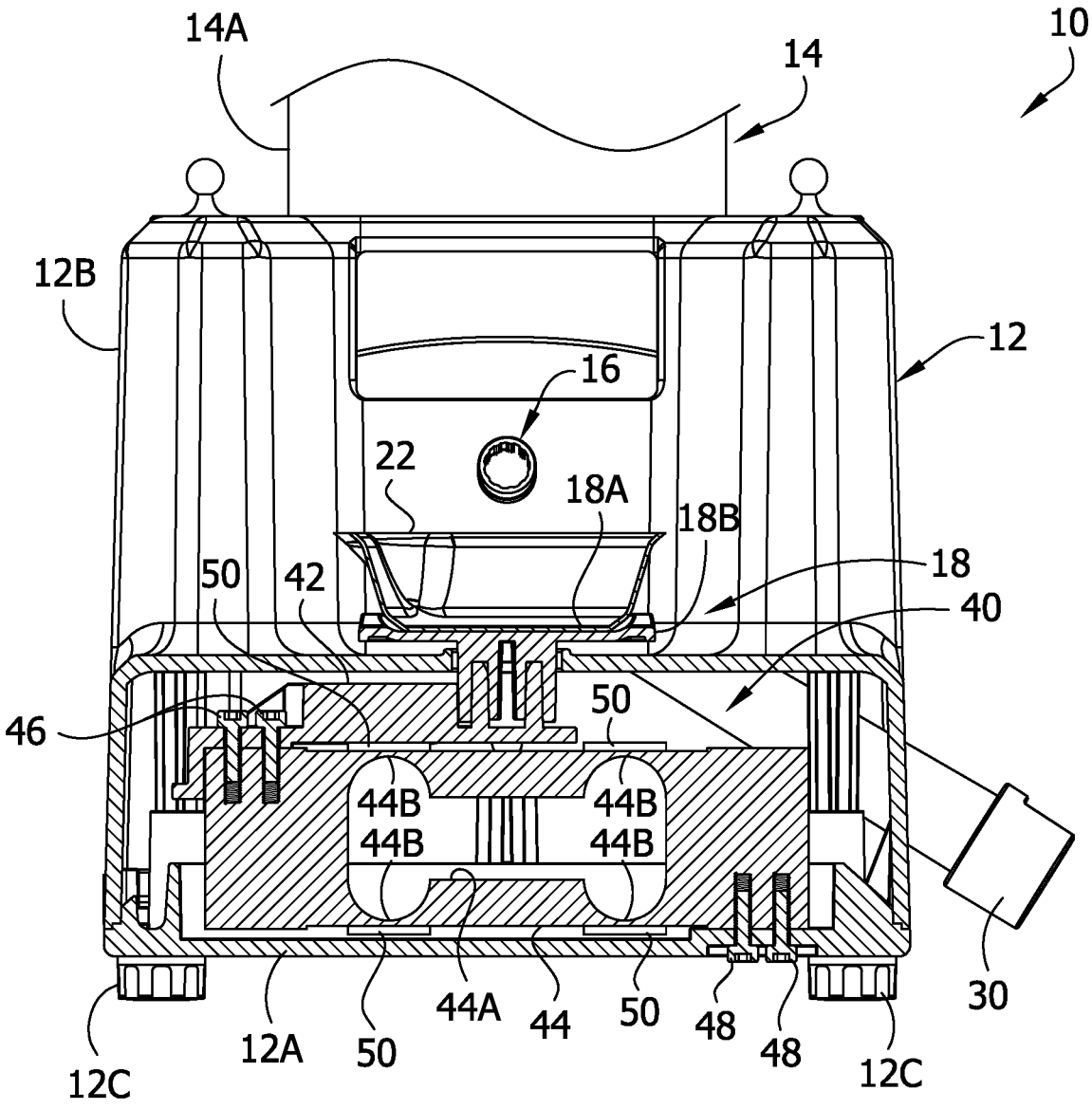
FIG. 4 is a fragmentary section of the powder dispenser taken in a plane including line 4-4 of FIG. 1.

Referring to FIGS. 2, and 4, the scale 18 includes the scale platform 18B and a scale sensor 40. The scale platform 18B includes the upper face 18A, which is sized and shaped to support a powder container such as the illustrated tray 22. Inside the housing 12, the scale 18 includes a first cantilevered beam 42 supporting the platform 18B. As shown in FIG. 4, the first beam 42 includes an end connected to the platform 18B and another end connected to a second cantilevered beam 44 by fasteners 46 (e.g., two screws). The second beam 44 is secured at its opposite end to the housing 12 by additional fasteners 48. The second beam 44 has a generally dog bone shaped opening 44A providing relatively thin beam portions 44B where four strain gauges 50 are applied to the second beam in a Wheatstone configuration. The combination of the group of strain gauges 50 and the beam 44 forms a load cell. The strain gauges 50 indicate a changed resistance value (scale signal) in response to flexure of the beam 44 proportional to the load on the scale platform 18B transferred to the load cell via the first beam 42. The load cell acts as the scale sensor 40 for sensing an amount of powder supported by the scale 18 and produces a corresponding scale signal. Other types of scale sensors, such as other types of load cells (e.g., having beams of other shapes or sizes, and/or having other numbers or arrangements of strain gauges), can be used without departing from the scope of the present invention. Referring to FIG. 2, the first beam 42 includes forward and rearward arms 42A, 42B arranged to contact upper ends of posts 52 inside the housing 12 to define maximum downward travel of the scale platform 18B relative to the housing.

In one aspect of the present disclosure, the conveyor tube 16 is supported by the housing 12 so the conveyor tube axis A1 extends distally away from the hopper 14 at an upward angle $\alpha$ with respect to horizontal when the face 18A of the scale platform 18B is horizontal. For example, the angle $\alpha$ can be in the inclusive range of 0 to 15 degrees, more desirably, 0.5 to 3 degrees, and in one embodiment is about 1 degree. This is different from known electronic dispensers having conveyor tubes that extend distally away from a hopper at a downward angle with respect to horizontal. The upward angle $\alpha$l of the tube 16 assists in preventing unwanted over dispensing of powder due to a powder being particularly free flowing. The advantage of the upward angled conveyor tube 16 can be appreciated by considering an extreme hypothetical case in which a powder flows as freely as water, such that as soon as the powder enters the conveyor tube from the hopper 14, the powder would flow through the conveyor tube and exit the distal end even if the conveyor is not operating. The upward angle of the conveyor tube 16 increases resistance to powder flow through the conveyor tube to minimize the effect of gravity in causing freely flowing powder to over dispense. In other words, the upward angle of the conveyor tube 16 assists in limiting powder dispensing to only the time during which the conveyor tube is rotating such that the dispenser 10 can more precisely control dispensing of powder to meet a target dispensing amount.

Figure 5:
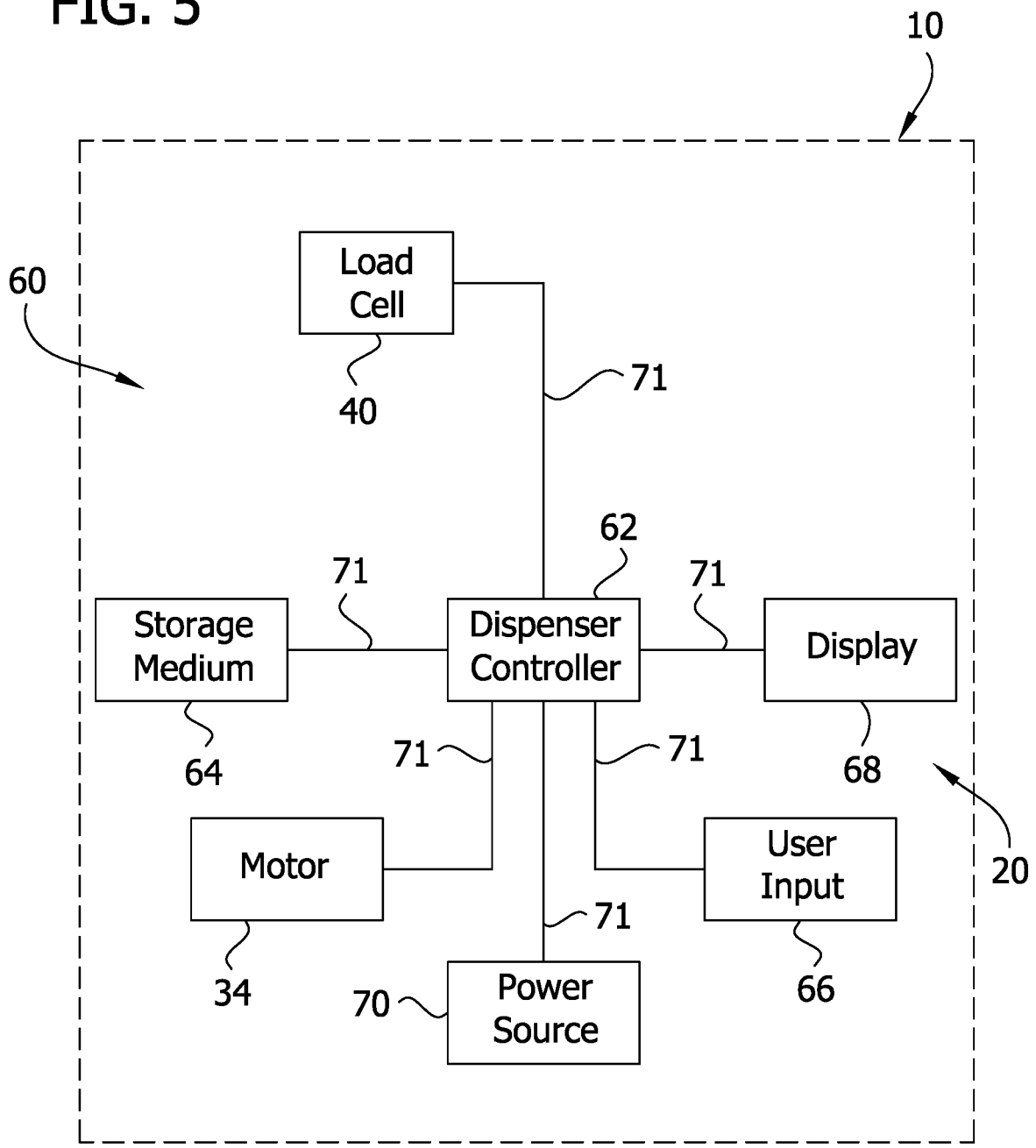
FIG. 5 is a schematic showing electronic components of the powder dispenser.

As shown schematically in FIG. 5, a control system 60 of the dispenser 10 includes a dispenser controller 62 (e.g., microprocessor or central processing unit), a non-transitory tangible storage medium 64 (e.g., including forms of storage such as software and/or firmware), and the user interface 20 including a user input 66 and a display 68. A power source 70 such as batteries or a power cord can be used for providing electrical power to the control system. The control system 60 includes interconnection electronics 71 (e.g., including electrical, fiber optic lines, and/or wireless communication devices) that operatively connect the various components of the control system with each other and with other components of the dispenser 10. For example, the dispenser controller 62 can receive the scale signals and user input signals via the interconnection electronics 71. It will be appreciated that the interconnection electronics 71 can include other components, such as A/D converters and/or filters through which signals such as the scale signal passes to the dispenser controller 62.

Figure 6:
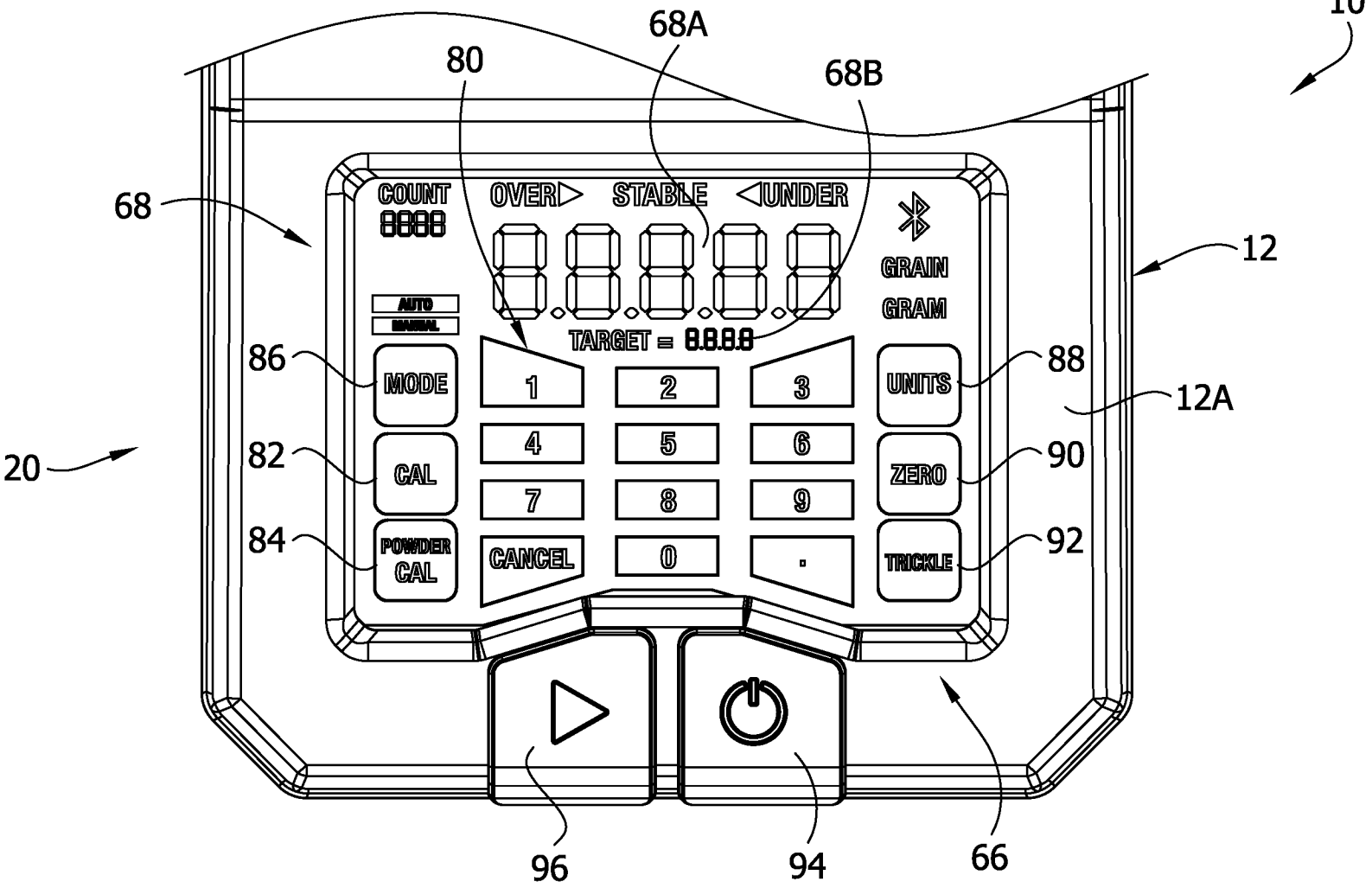
FIG. 6 is a fragmentary top view of the dispenser showing a user interface of the dispenser.

As shown in FIG. 2, a printed circuit board assembly 72 in the housing 12 can be configured to include the dispenser controller 62 and the storage medium 64. The dispenser controller 62 is configured to read and execute instructions stored in the storage medium 64, and is responsive to the user input 66, for controlling operation of the dispenser 10. A user can enter and/or modify instructions stored on the storage medium 64 via the user input 66. In the illustrated embodiment, as shown in FIG. 6, the user interface 20 comprises a touch screen, described in further detail below. Other types of user interfaces can be used without departing from the present invention. The user interface 20 provides command signals via the interconnection electronics 71 to the dispenser controller 62. The command signals (e.g., target mass signal) can include changes to data (e.g., target mass of powder to be dispensed) stored in the tangible storage medium 64. The dispenser controller 62 responds to the command signals and provides control signals corresponding thereto via the interconnection electronics 71 to the conveyor. It will be appreciated that in other embodiments the dispenser controller 62 and/or the tangible storage medium 64 can be part of another device such as a smart phone or tablet operatively connectable to the conveyor 16 and scale 18 (e.g., wirelessly) without departing from the scope of the present invention.

Referring to FIG. 6, in the illustrated embodiment, the user interface 20 comprises a touch screen, including both a user input 66 and a display 68. The display 68 includes a liquid crystal display screen, and the user input 66 can include a touch-sensitive panel on the display screen. The display 68 includes a first numerical display 68A for displaying a mass of powder currently supported by the scale 18. The display 68 includes a second numerical display 68B for displaying a target amount of powder to be dispensed. The user input 66 includes actuators at various areas of the touch screen where the touch screen is responsive to the touch of a user. The actuators may be identifiable to the user by text or graphic information on the display 68 at respective areas of the touch sensitive panel. The user input 66 includes actuators arranged as a number pad 80 adapted for receiving user input such as a target mass of powder to be dispensed, which results in a target mass signal sent to the dispenser controller 62. The user input 66 includes a CAL actuator 82 for performing a calibration of the scale 18 during which the user supports two weights 83 (FIG. 1) of known mass (e.g., 50 grams each) on the scale platform 18B to calibrate the scale. The user input 66 includes a POWDER CAL actuator 84 for implementing a powder calibration sequence, described below, during which the dispenser 10 learns flow characteristics of a powder to be dispensed. A MODE actuator 86 permits the user to select among different modes, such as a manual dispensing mode and an automatic dispensing mode. A UNITS actuator 88 is provided for changing between grains and grams. A ZERO actuator 90 is provided for zeroing or taring the scale 18 (e.g., to account for the tray 22 supported on the scale platform 18B). A TRICKLE actuator 92 permits the user to manually trickle powder from the conveyor 16 to the scale 18. The user input 66 also includes other actuators, including an on/off actuator 94 and an execute actuator 96, which are not part of the touch screen. Other types of user interfaces can be used without departing from the scope of the present invention. For example, the display 68 and user input 66 can be separate from one another. The display 68 can include other types of screens or indicators. Moreover, the user input 66 can comprise other types of actuators, such as keyboards, mice, buttons, switches, or even microphones for receiving information from the user.

Example operations of the dispenser 10 will now be described with respect to FIGS. 7A-8E. As outlined in FIGS. 7A-7C, an initial step the user may choose to execute is a powder calibration sequence 100 during which the dispenser 10 in a powder calibration mode executes one or more powder calibration cycles. As explained below, goals of the powder calibration sequence 100 are to learn dispense rates of the powder at different conveyor speeds and to set dispensing parameters (e.g., conveyor speeds for calibrated dispense rates) so subsequent dispensing of the powder can be accurate. After the powder calibration sequence, in a dispensing mode (outlined in FIGS. 8A-8E) the user can execute a dispensing sequence 102 to dispense a target amount of powder. The dispensing sequence 102 can include one or more dispensing cycles in which the conveyor 16 operates at different speeds (e.g., stepped down speeds) to optimize quickness of dispensing without sacrificing dispensing precision. During a dispensing cycle, the dispenser 10 desirably monitors dispensing characteristics (e.g., real time dispense rate) and sets dispensing parameters (e.g., conveyor run end time) to further optimize quickness and precision of dispensing. Optionally, the powder calibration sequence 100 can be skipped by proceeding directly to a dispensing sequence 102.

When powder has been loaded into the hopper 14, a powder calibration sequence 100 can be initiated by pressing the POWDER CAL actuator 84. The dispenser 10 executes a series of powder calibration cycles to determine a dispense rate of the powder at different conveyor speeds in preparation for a later dispensing sequence 102. The first step in the calibration sequence 100 is to prime 104 the dispenser 10 by turning the conveyor tube 16 for a preset time, such as 4 seconds. This causes powder from the hopper 14 to enter the conveyor tube 16 through the openings 16A, to substantially fill the conveyor tube, and to begin falling out of the open distal end of the conveyor tube. Accordingly, powder in the conveyor tube 16 is ready to be immediately dispensed when the conveyor tube begins turning again. The powder dispensed during priming can be removed from the tray 22 or the scale 18 can be tared. Alternatively, the powder from priming can remain in the tray 22 and the dispenser can use that mass as its 0 point.

The dispenser 10 then proceeds to calibrate 106 for a first dispense rate. For example, the first dispense rate can be a relatively fast rate. The tangible storage medium 64 stores a default speed at which to operate the conveyor 16 for the fast dispense rate. The default speed can be stored in terms of a duty cycle or voltage for the motor 34 for turning the conveyor tube. For example, the stored value can be 60% duty cycle, which would be the equivalent of 7.2 volts for the 12 volt motor. The conveyor 16 operates 108 at this speed for a default time, such as 4 seconds. The conveyor 16 stops and the dispenser controller 62 waits for the scale reading to stabilize. After weighing 110 the powder dispensed, the dispenser controller 62 calculates 112 the dispense rate of the powder dispensed for the 4 seconds (mass divided by time). By comparing 114 the calculated dispense rate with a range of dispense rates stored in the tangible storage medium 64, the dispenser controller 62 determines whether the calculated dispense rate is greater than desired or less than desired. The desired dispense rate can be stored as a preset range such as the range of 4 to 6 grains per second. If the calculated dispense rate is greater than desired, the dispenser controller 62 conducts 116 another calibration cycle at a conveyor speed less than the previous conveyor speed. For example, the motor 34 may be operated at 55% duty cycle (dispensing parameter) instead of 60% duty cycle. On the other hand, if the calculated dispense rate is less than the desired dispense rate, the dispenser controller 62 conducts 118 another calibration cycle at a conveyor speed greater than the previous conveyor speed, such as 65% instead of 60% duty cycle. This process is repeated if necessary until the resulting dispense rate is within the desired range. The duty cycle (broadly, dispensing parameter) used to achieve the calibrated fast dispense rate is saved 120 to the tangible storage medium 64 for later use in the dispensing mode.

Figure 7A:
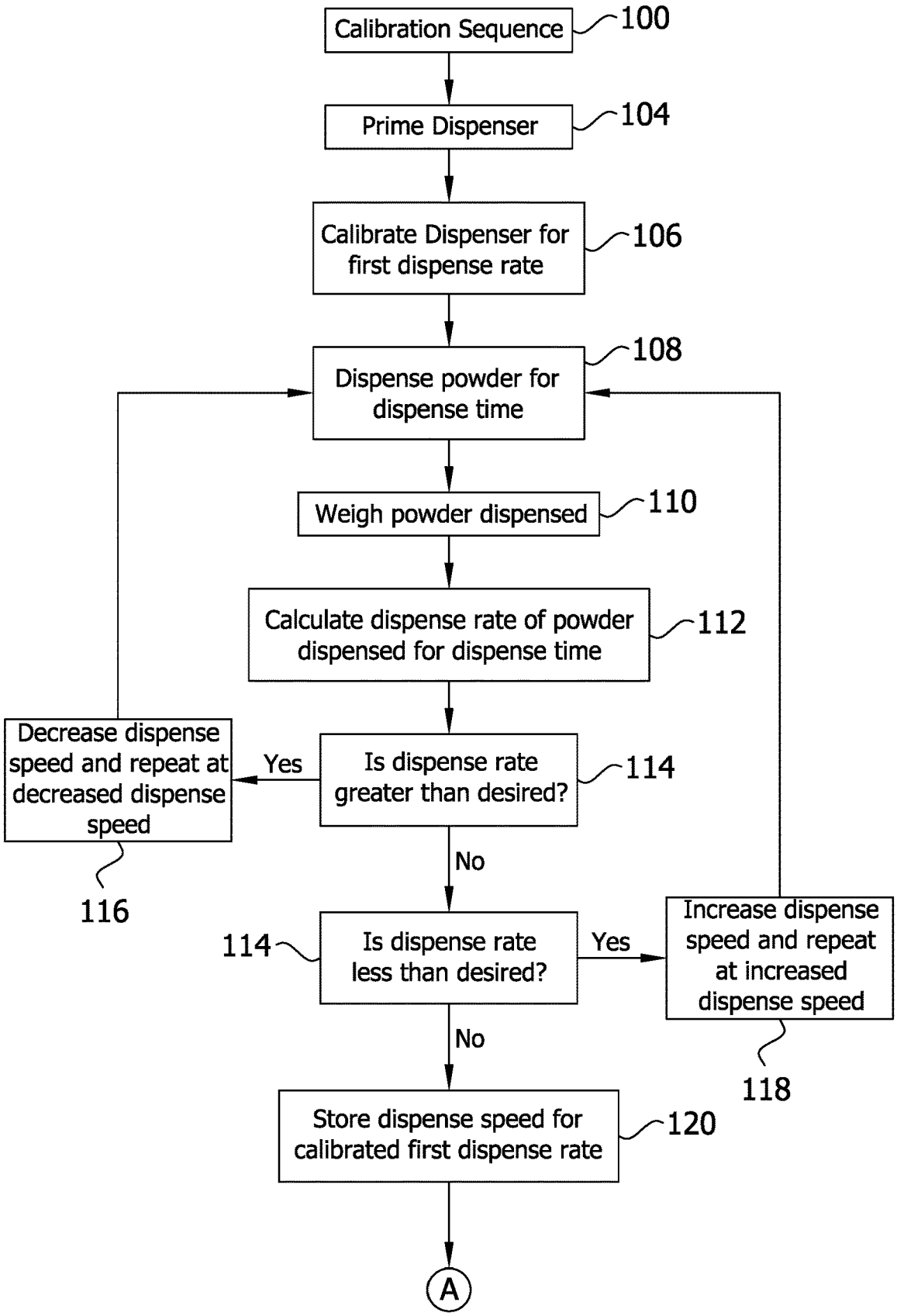
FIGS. 7A-7C are flow charts of a calibration algorithm for execution by the powder dispenser.
Figure 7B:
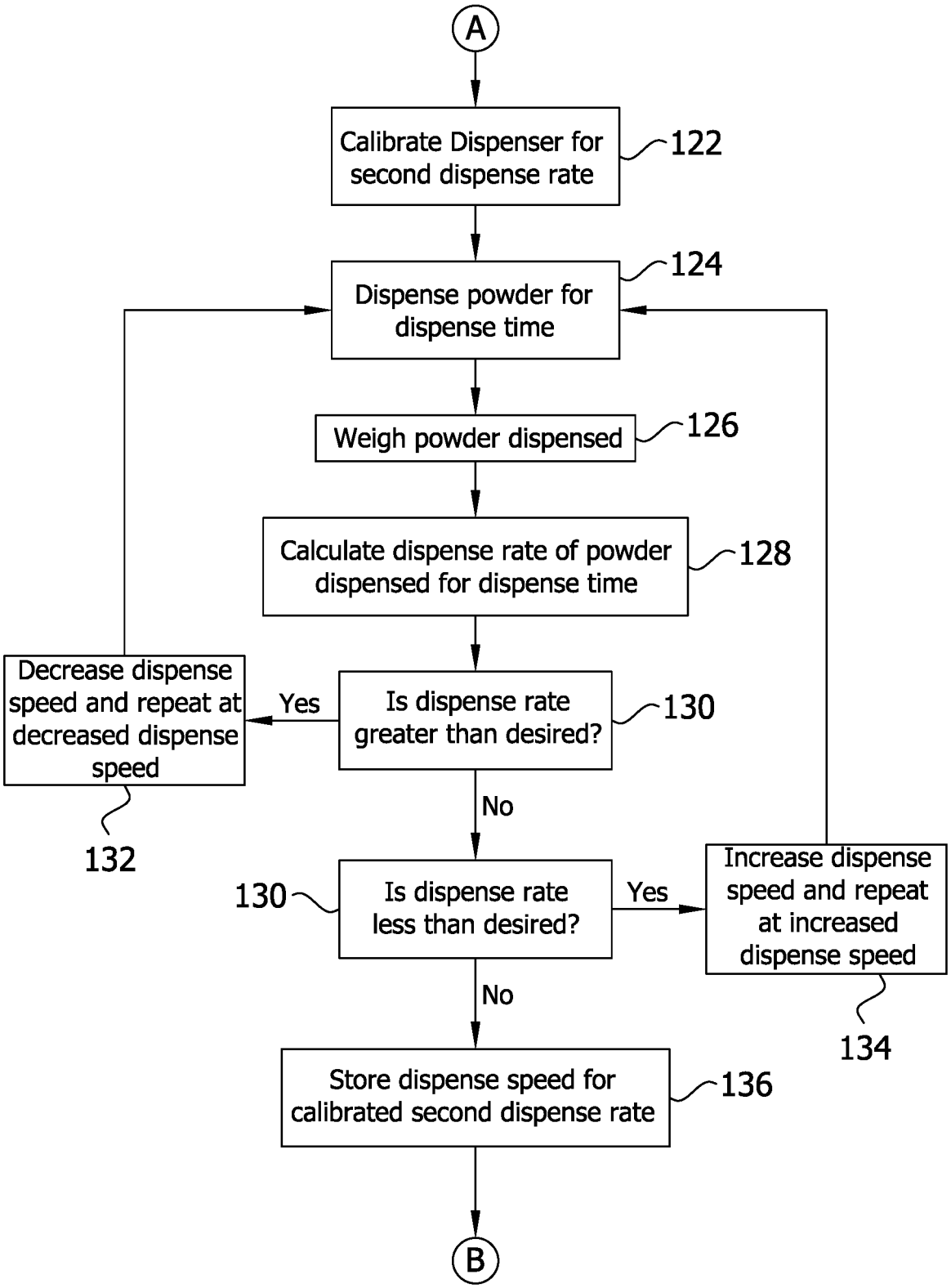

Referring to FIG. 7B, after calibrating for the fast dispense rate, the powder calibration sequence continues with calibration for a second dispense rate 122. For example, the second dispense rate can be less than the first dispense rate and will be referred to as a medium dispense rate. The conveyor 16 is operated 124 for a preset time (e.g., 4 seconds) at a preset default conveyor speed, such as a motor duty cycle of 35%. When the conveyor 16 stops, the scale 18 is permitted to stabilize, the amount of powder dispensed is weighed 126, and the dispense rate is determined 128. The dispenser controller 62 compares 130 the calculated dispense rate with a preset desired dispense rate, which can be the range of 1.5 to 3 grains per second. If the calculated dispense rate exceeds the desired dispense rate, the calibration cycle is repeated 132 at a slower conveyor speed (e.g., 30% duty cycle). If the calculated dispense rate is less than the desired dispense rate, the calibration cycle is repeated 134 at a faster conveyor speed (e.g., 40% duty cycle). This process is repeated if necessary until the resulting dispense rate is within the desired range. The duty cycle (broadly, dispensing parameter) used to achieve the calibrated medium dispense rate is saved 136 to the tangible storage medium 64 for later use in the dispensing mode.

Figure 7C:
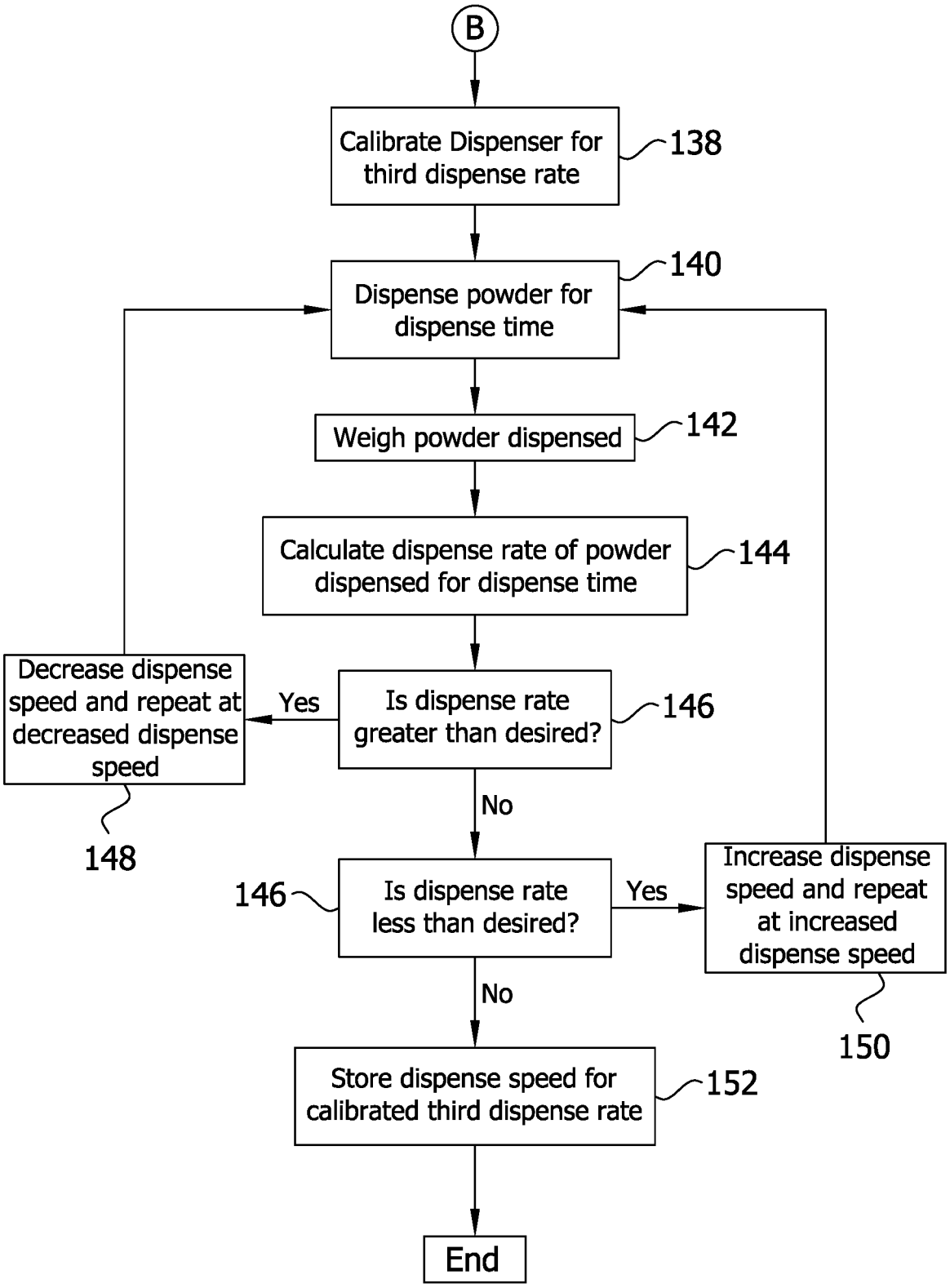

Referring to FIG. 7C, after calibrating for the second dispense rate, the powder calibration sequence continues with calibration 138 for a third dispense rate. For example, the third dispense rate can be less than the second dispense rate and will be referred to as a slow dispense rate. The conveyor 16 is operated 140 for a preset time (e.g., 4 seconds) at a default conveyor speed, such as a motor duty cycle of 18%. When the conveyor 16 stops, the scale 18 is permitted to stabilize, the amount of powder dispensed is determined 142, and the dispense rate is determined 144. The dispenser controller 62 compares 146 the calculated dispense rate with a preset desired dispense rate, such as the range of 0.5 to 0.25 grains per second. If the calculated dispense rate exceeds the desired dispense rate, the calibration cycle is repeated 148 at a slower conveyor speed (e.g., 16% duty cycle). If the calculated dispense rate is less than the desired dispense rate, the calibration cycle is repeated 150 at a faster conveyor speed (e.g., 20% duty cycle). This process is repeated as necessary until the resulting dispense rate is within the desired range. The duty cycle (broadly, dispensing parameter) used to achieve the calibrated slow dispense rate is saved 152 to the tangible storage medium 64 for later use in the dispensing mode.

It will be appreciated that the powder calibration sequence described above is provided by way of example without limitation. Other powder calibration sequences can be used without departing from the scope of the present invention. For example other numbers of calibration cycles (e.g., one) can be used. Moreover, the powder calibration sequence can be skipped or omitted without departing from the scope of the present invention.

When ready to dispense powder, the user can begin by pressing the MODE actuator 86 to enter the manual dispensing mode. Next, the user can press number actuators on the number pad 80 to enter a target powder mass to be dispensed. This value received 154 by the dispenser controller 62 is saved to the tangible storage medium 64 and is displayed at the second numerical display 68B. When the user presses the execute actuator 96, the dispenser 10 will begin a dispense sequence. The dispenser controller 62 executes instructions stored on the storage medium 64 to choose 156 an initial dispense rate. To do this, the dispenser controller 62 determines 158 a mass difference by subtracting the current scale mass reading from the target mass. In this example, assuming the user zeroed the scale 18 with the empty tray 22 on the scale platform 18B, the current scale mass reading would be 0 grains and the mass difference would be the same as the target mass. The next steps depend 160 on whether the powder calibration sequence was performed. If yes, the powder dispense rates and associated conveyor speeds may be used. If not, preset default powder dispense rates and associated conveyor speeds are used, as discussed later.

Figure 8A:
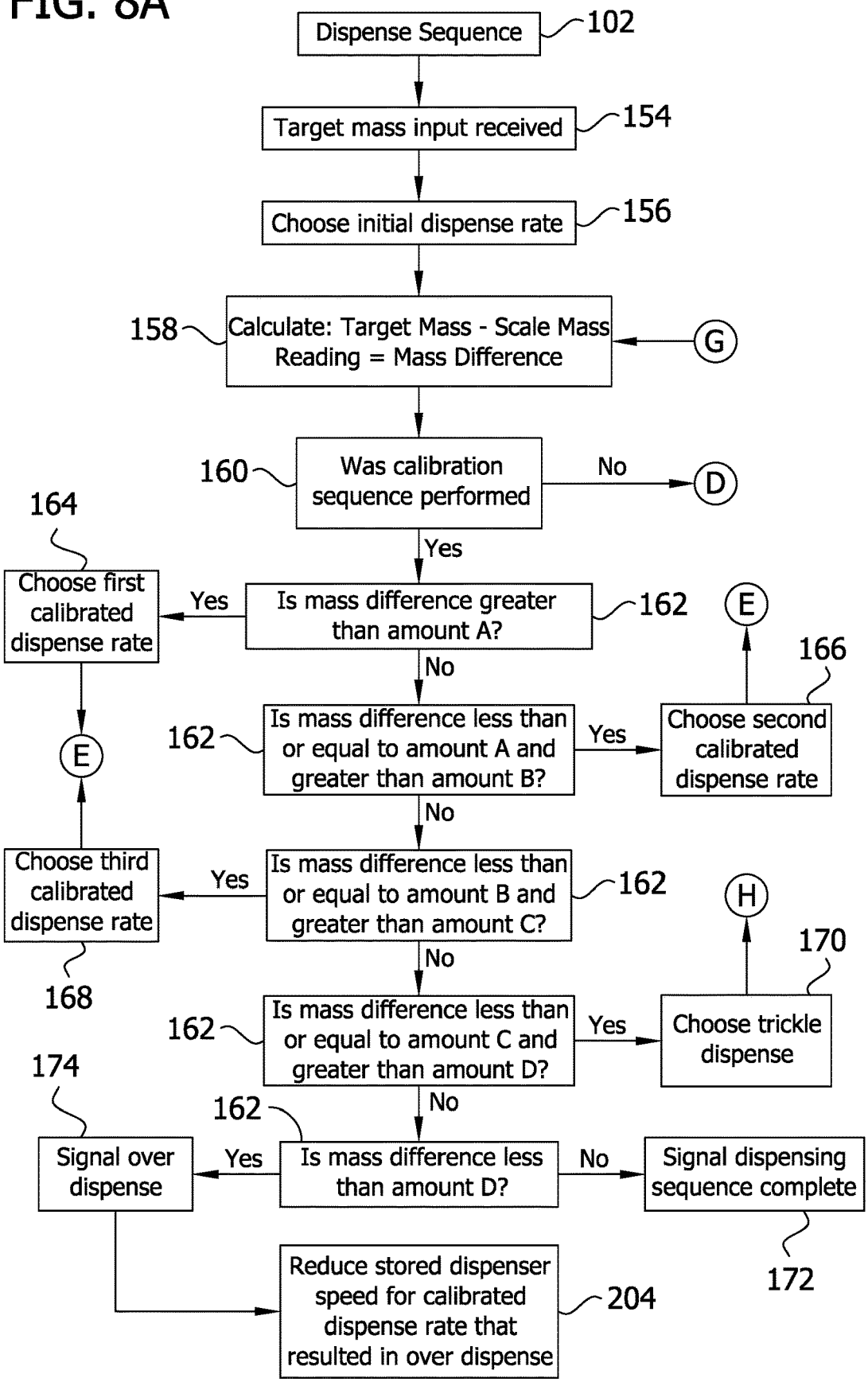
FIGS. 8A-8E are flow charts of a powder dispensing algorithm for execution by the powder dispenser.
Figure 8B:
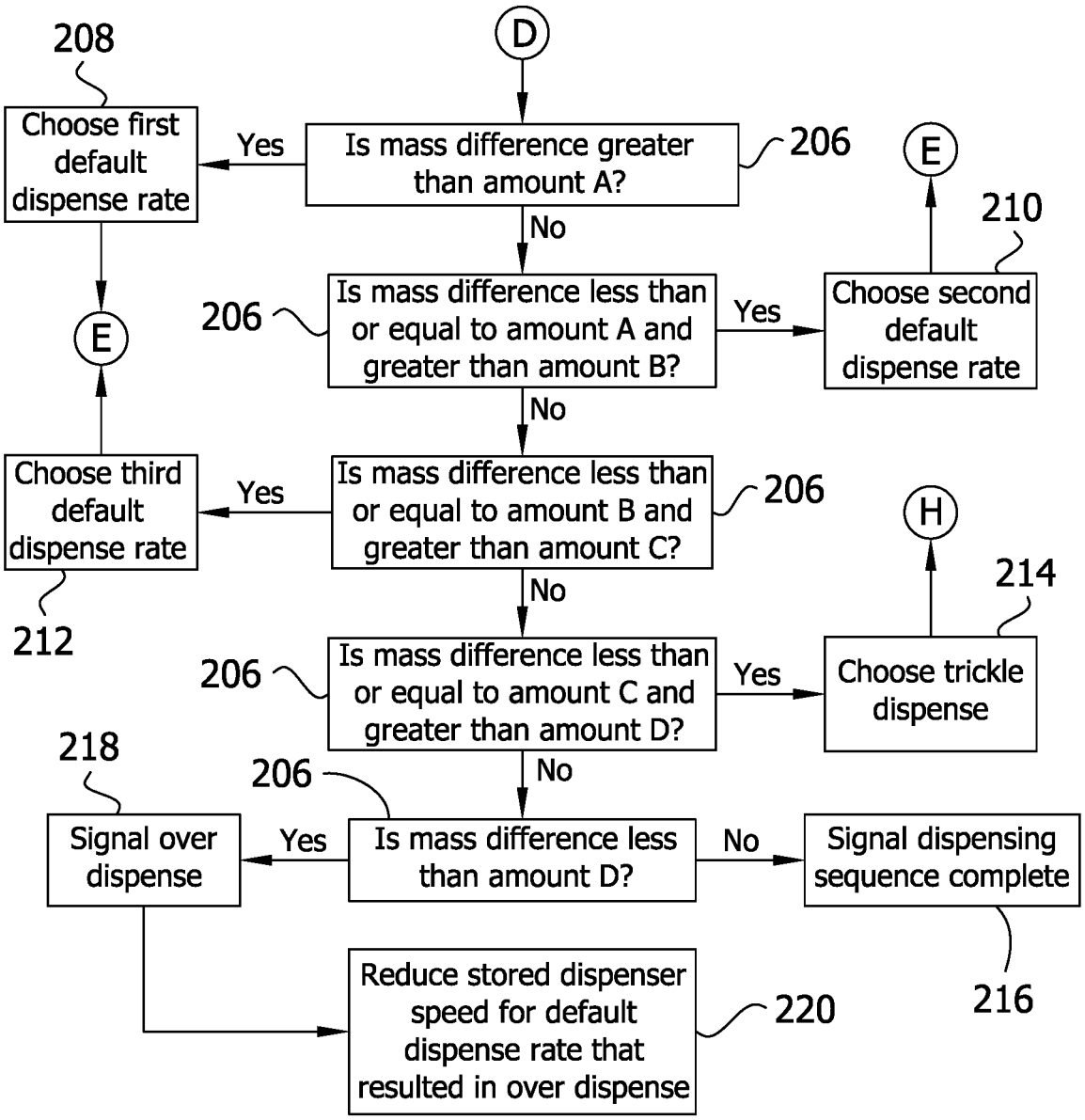

Still referring to FIG. 8A, the controller 62 proceeds to determine 162 whether the mass difference falls into a preset one of multiple mass difference ranges to determine whether to begin the dispensing sequence with a dispensing cycle using the calibrated fast, medium, or slow dispense rate. The controller 62 references a first schedule of mass difference ranges for choosing the dispense rate for the first dispensing cycle. For example, if the mass difference is greater than an amount A (e.g., 15 grains), the fast dispense rate is chosen 164. If the mass difference is less than or equal to amount A and greater than amount B (e.g., 6 grains), the medium dispense rate is chosen 166. If the mass difference is less than or equal to amount B and greater than amount C (e.g., 0.1 grains), the slow dispense rate is chosen 168. If the mass difference is less than or equal to amount C and greater than amount D (e.g., 0 grains), trickle dispensing is chosen 170. It will be appreciated that the initial mass difference will often be greater than amount A or greater than amount B, such that the fast or medium dispense rate is chosen first.

Figure 8C:
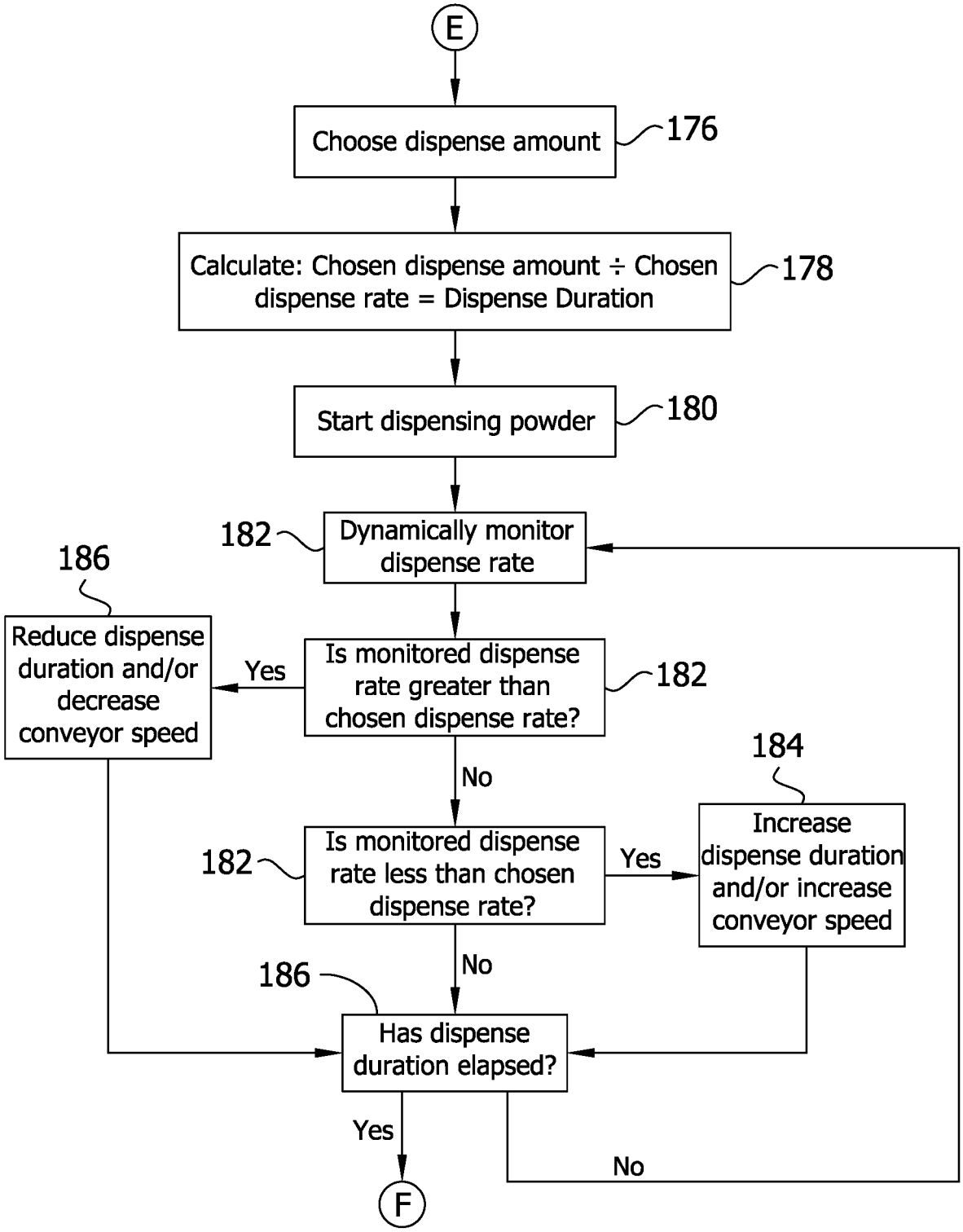

Referring to FIG. 8C, assuming the fast, medium, or slow dispense rate is chosen, the dispenser controller 62 proceeds to choose 176 an amount of powder to be dispensed in the dispensing cycle using that dispense rate. For example, the amount to be dispensed in that dispensing cycle can be chosen by applying an offset value stored in the storage medium 64. The offset value is subtracted from the current mass difference. The fast, medium, and slow dispense rates can have respective different offset values. For example, the offset value for the fast flow rate can be 1 grain, the offset value for the medium flow rate can be 0.25 grains, and the offset value for the slow flow rate can be 0.1 grains. The offset value can provide a margin of error to assist in avoiding over dispensing powder in a dispensing cycle. Other offset values can be used without departing from the scope of the present invention. Moreover, offset values need not be used, and the amount of powder to be dispensed in a given dispensing cycle can be the same as the current mass difference.

After choosing the amount of powder to be dispensed in the dispensing cycle, the dispenser controller 62 determines 178 for how long to operate the conveyor tube 16 in that dispensing cycle. The dispenser controller 62 calculates this value by dividing the chosen amount of powder to be dispensed in that dispensing cycle by the calibrated value for the fast, medium, or slow dispense rate to be used for that dispensing cycle. The resulting time value will be referred to as a dispensing cycle run end time or a conveyor run end time.

To dispense powder during the dispensing cycle, the dispenser controller 62 operates 180 the motor 34 to turn the conveyor tube 16 continuously until the conveyor run end time. The motor 34 rotates the conveyor tube 16 at the motor duty cycle (conveyor speed) saved to the storage medium 64 for the calibrated fast, medium, or slow dispense rate during the powder calibration sequence. For example, the motor 34 can be operated at 60% duty cycle for the calibrated fast dispense rate, 35% duty cycle for the medium dispense rate, or 18% duty cycle for the slow dispense rate. It will be appreciated that the run end time can be monitored in various ways. For example, the dispenser controller 62 can implement a count up clock, a count down clock, or can set a future time and continuously compare the future time to a real time clock.

As powder is being dispensed, the dispenser controller 62 monitors 182 the dispense rate of the powder and can update or reset the dispensing cycle run end time as needed. As powder is dispensed and becomes supported by the scale platform 18B, the scale 18 will begin providing scale sensor feedback to the dispenser controller 62. The scale sensor feedback is delayed because at any given time during the dispensing cycle, the amount of powder supported by the scale 18 is less than the amount of powder that has exited the conveyor tube, and because of latency in the scale signal reaching the dispenser controller 62. For example, if a low pass filter (or other device) is used for stabilizing the scale signal, the dispenser controller 62 may receive the scale signal about every 0.1 seconds. After about 0.4 seconds of rotating the conveyor tube, the dispenser controller 62 can begin monitoring the dispense rate of the powder being dispensed. Mass readings and associated times are stored in a table in the tangible storage medium about every 0.1 seconds of the dispensing cycle. The dispenser controller 62 can determine real time dispense rate from this data in a variety of ways. For example, each time the dispenser controller 62 receives a scale signal, the dispenser controller can apply a linear regression line to a plot of the complete set of mass readings and associated times from the dispensing cycle (time along X-axis, mass along Y-axis). The dispenser controller 62 determines the slope of the linear regression line and saves the slope to the tangible storage medium 64 as the current dispense rate of the powder. If the current dispense rate of powder is different than the calibrated dispense rate of powder for that dispensing cycle, the dispenser controller 62 adjusts or resets the dispensing cycle run end time (broadly, dispensing parameter) by increasing 184 or decreasing 186 to the value of the offset mass difference divided by the current dispense rate. The dispenser controller 62 can continuously monitor 182 the current dispense rate in this manner and repeatedly update or reset 184, 186 the dispensing cycle run end time. The monitoring of the dispense rate and dynamic updating of the run end time can account for irregularities caused by factors such as reduced powder supply (and thus reduced downward pressure on remaining powder) in the hopper 14, variations in moisture content of the powder in the hopper, etc. It will be appreciated that the real time flow rate can be determined in other ways, and the dispensing cycle run end time can be determined in other ways, without departing from the scope of the present invention.

It will be appreciated that instead of changing the dispensing cycle run end time, the speed of the conveyor can be changed (increased or decreased) based on the real time dispense rate, to reduce variance of the real time dispense rate from the desired dispense rate (e.g., calibrated dispense rate) for that dispensing cycle. For example, the conveyor speed would be modified 184, 186 (FIG. 8C) during the dispensing cycle to achieve the dispense rate used to determine the initial dispensing cycle run end time. The conveyor speed could be continuously adjusted as needed to maintain the real time dispense rate at the desired dispense rate. Moreover, a combination of changing the dispensing cycle run end time and changing the conveyor speed could be used without departing from the scope of the present invention.

Figure 8D:
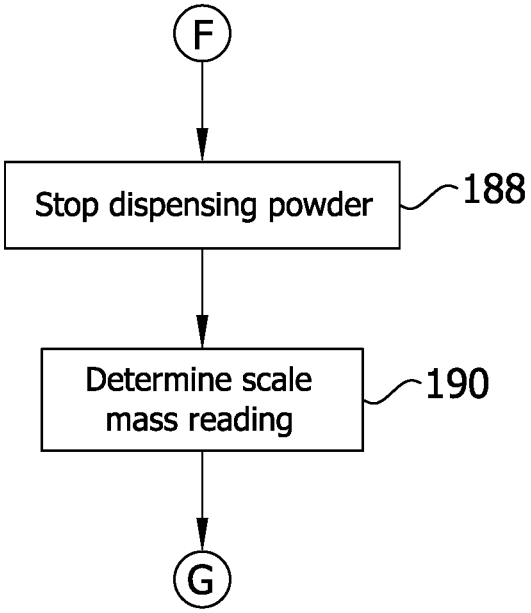

Upon reaching 186 the dispensing cycle run end time, the dispenser controller 62 will stop rotating 188 the conveyor tube (see FIG. 8D). Because the dispense rate of the powder was calibrated and monitored during the dispensing cycle, and because the dispensing cycle run end time was repeatedly updated during the dispensing cycle, the dispensing cycle run end time is a good prediction of when to stop rotating the conveyor tube 16 such that the chosen dispense amount is dispensed without over or under dispensing. Inertia of the motor 34 and/or conveyor tube, or other factors, may cause additional powder to fall from the conveyor tube, and this powder is desirably less than the offset amount applied to choose the dispense amount for the dispensing cycle. The dispenser controller 62 waits (e.g., about 4 seconds) for the scale reading to stabilize and then determines 190 and saves the final mass reading for the first dispensing cycle.

Referring to FIG. 8A, the dispenser controller 62 then determines 158 the current mass difference by subtracting the mass of the powder currently supported by the scale 18 from the target mass. The dispenser controller 62 then determines 162 whether the current mass difference is in one of multiple ranges of mass difference in the storage medium 64 to select a dispense rate for a next dispensing cycle, if any. Instead of using the first schedule of mass differences used for selecting the dispense rate for the initial dispensing cycle, the dispenser controller 62 may reference a second schedule of mass differences for dispensing cycles subsequent to the initial dispensing cycle of a dispensing sequence. For example, if the mass difference is greater than an amount A (e.g., 1 grain), the fast dispense rate is chosen 164. If the mass difference is less than or equal to amount A and greater than amount B (e.g., 0.25 grains), the medium dispense rate is chosen 166. If the mass difference is less than or equal to amount B and greater than amount C (e.g., 0.1 grains), the slow dispense rate is chosen 168. If the mass difference is less than or equal to amount C and greater than amount D (e.g., 0 grains), trickle dispensing is chosen 170. For example, if the current mass difference falls into the range associated with the medium dispense rate, the medium dispense rate will be chosen 166 for a next dispensing cycle. On the other hand, if the current mass difference falls into the range associated with the slow dispense rate, the slow dispense rate will be chosen 168 for a next dispensing cycle. In either case, the dispenser controller 62 would proceed to execute a second dispensing cycle in a similar fashion as described above with respect to the fast dispense rate but with the offset value for the medium or slow dispense rates. An amount of powder to be dispensed during that dispensing cycle would be chosen 176, a run end time would be calculated 178, and powder would be continuously dispensed 180 by rotating the conveyor tube 16 at the motor duty cycle stored for that dispense rate. If the duration of the dispensing cycle is longer than 0.4 seconds, while the powder is being dispensed the dispense rate would be monitored 182 as explained above and the run end time would be dynamically updated 184, 186, until reaching the run end time 186.

Figure 8E:
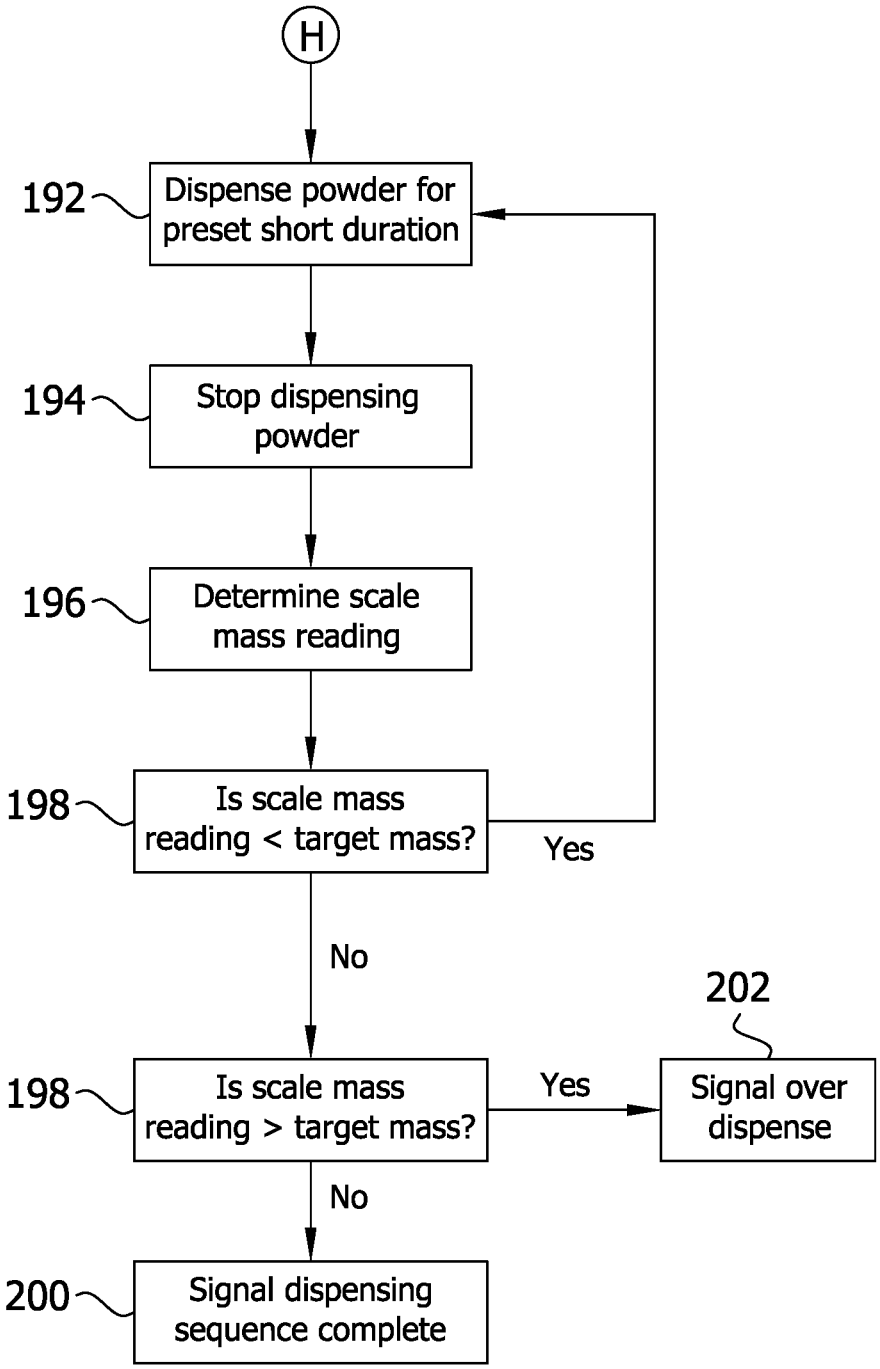

When the current mass difference is determined 162 to be less than or equal to the amount C (e.g., 0.1 grains) and greater than amount D (e.g., 0 grains), trickle dispensing is chosen 170 to dispense the remaining amount of powder to reach the target powder amount to finish the dispensing sequence. Referring to FIG. 8E, the trickle dispensing cycle is different than the dispensing cycles described above because the trickle dispensing cycle is intermittent rather than continuous, and the trickle dispensing cycle is terminated based on the scale 18 reading rather than on a run end time. In the trickle dispensing cycle, an offset is not used. In the trickle dispensing cycle, the dispenser controller 62 turns 192 the conveyor tube 16 for short preset trickle cycle segments, such as 0.018 seconds each. The conveyor tube speed can be the same as for the slow dispense rate (e.g., 18% motor duty cycle). After each trickle cycle segment, the operation of the conveyor tube 16 is paused 194 to permit the scale reading to stabilize and be recorded 196. The dispenser controller 62 compares 198 the scale reading to the target mass. If the scale mass reading is less than the target mass (or if the current mass difference is greater than zero), the trickle dispensing cycle continues for additional cycle segments as necessary. In each additional trickle dispensing cycle segment, the conveyor tube 16 is rotated for another 0.018 seconds. When the scale mass reading equals the target mass, the trickle dispensing cycle and the overall dispensing sequence is complete 200. If the scale reading happens to be greater than the target mass, the display signals 202 an over dispense.

When the dispensing cycle is complete, the user will typically remove the tray 22 from the scale 18 and deposit the powder from the tray into an ammunition shell or case (not shown). After the tray 22 is repositioned on the scale 18, the user can press the execute actuator 96 to manually initiate another dispensing sequence. The dispenser 10 would execute the dispensing sequence steps outlined above to dispense the same target mass unless a different target mass is entered by the user. The number of dispensing cycles and/or the mass readings at the end of each dispensing cycle may not be the same from one dispensing sequence to the next, but desirably the target mass is achieved at the end of each dispensing sequence. If desired, the user can press the MODE actuator 86 to enter an automatic dispensing mode in which the dispenser 10 executes dispensing sequences as described above, but the dispensing controller 62 starts the automatic dispensing sequences in response to sensing the tray 22 repositioned on the scale platform 18B, rather than when the user presses the execute actuator.

After any dispensing cycle, if the scale reading is greater than the target mass value, the dispensing sequence is terminated 174, 202 and the display 68 alerts the user that an over dispense has occurred. If an over dispense occurs, the dispenser controller 62 reduces 204 (FIG. 8A) the stored conveyor speed (broadly, dispensing parameter) associated with the calibrated dispense rate that resulted in the over dispense. For example, the dispenser controller 62 can store a lower motor duty cycle in the storage medium 64 for that calibrated dispense rate. Desirably, the reduced conveyor speed will not result in an over dispense in the next dispense sequence.

As mentioned above, the powder calibration sequence can be skipped or omitted if desired. In such a case, as shown by comparison of FIGS. 8A and 8B, the dispensing mode would operate in a fashion similar to described above but having some differences. After the target mass input is received 154, and the mass difference is calculated 158, whether the fast, medium, slow, or trickle dispensing is used as the first dispense rate can be chosen 206, 208, 210, 212, 214 based on the same criteria discussed above (the same values for amounts A, B, C, and D). The offsets used 176 in dispensing cycles for the fast dispense rate, medium dispense rate, and slow dispense rate can also be the same as explained above. However, because the actual dispense rates for the fast, medium, and slow dispense rates were not calibrated, conservative default preset dispense rate values are used 178. For example, the default preset fast dispense rate may be 6 grains per second at 60% motor duty cycle, the default preset medium dispense rate may be 3 grains per second at 35% motor duty cycle, and the default preset slow dispense rate may be 0.5 grains per second at 18% motor duty cycle.

To assist in preventing over dispensing, these default preset dispense rates for the associated motor duty cycles are intentional over estimates to account for the worst case scenario of a rather freely flowing powder. The result is when the run end time is calculated 178 by dividing the amount of powder to be dispensed in a dispensing cycle by the default preset dispense rate, the initial duration of the dispensing cycle will likely be shorter than necessary to actually dispense the chosen amount of powder for that dispensing cycle. However, as explained above with reference to FIG. 8C, if the dispensing cycle lasts longer than 0.4 seconds, the real time flow rate will be monitored 182, and the run end time will be continually updated 184, 186 based on the calculated flow rate. In many cases, the dynamic updating or resetting of the run end time will result in lengthening of the dispensing cycle so that the conveyor tube 16 turns for a longer time than initially calculated. Because the dispense rate of the powder is monitored during the dispensing cycle, and because the dispensing cycle run end time is repeatedly updated during the dispensing cycle, the dispensing cycle run end time is a good prediction of when to stop rotating the conveyor tube 16 such that the chosen dispense amount is dispensed without over or under dispensing. After one or more dispensing cycles, the mass difference will desirably equal zero, and the display will signal 216 to the user that dispensing is complete, but if too much powder was dispensed, the display will signal 218 an over dispense. Assuming the same powder and the same ending target powder mass, a dispensing sequence without prior powder calibration may take longer than a dispensing sequence with prior powder calibration, but will desirably be about as precise in dispensing the chosen amount of powder for each dispensing cycle and in meeting the exact target mass at the end of the dispensing sequence.

When a prior powder calibration sequence was not used, a first powder dispensing sequence can be viewed in a sense as a calibration sequence. More specifically, when a dispensing cycle is performed, the actual dispense rate of the powder is determined 182 and can be saved to the storage medium 64 as associated with the default preset motor duty cycle. The next time a dispensing cycle calls for use of that motor duty cycle, the dispenser controller 62 can use the saved actual dispense rate for the powder to calculate a more accurate initial run end time (broadly, dispensing parameter).

As with a dispensing sequence with prior powder calibration that results in an over dispense, a dispensing sequence without prior powder calibration that results 218 in an over dispense can cause the dispenser controller 62 to reduce 220 the stored speed of the conveyor tube 16 (e.g., the stored motor duty cycle, a dispensing parameter) to dispense the powder at a lesser rate next time that category of dispense rate (fast, medium, or slow) is used, to assist in preventing another over dispense.

Example 1

Assume a user would like to perform a powder calibration pursuant to FIGS. 7A-7C and then dispense a load of 50 grains of powder pursuant to FIGS. 8A and 8C-8E. The user supplies the powder to the hopper 14. The user presses the POWDER CAL actuator 84. The conveyor tube 16 rotates for 4 seconds to prime the conveyor tube. The conveyor tube 16 stops rotating and the signal from the scale sensor 40 is permitted to stabilize. The dispenser controller 62 uses the mass reading as its 0 point. Then the conveyor tube 16 turns at the preset default 60% motor duty cycle for 4 seconds. The conveyor tube 16 stops rotating and the signal from the scale sensor 40 is permitted to stabilize. The dispenser controller 62 subtracts the scale mass reading from the mass reading after priming to yield 25 grains. The 25 grains is divided by the 4 seconds to calculate 6.25 grains per second dispense rate. Because the 6.25 grains per second is outside the range of 4 to 6 grains per second, the calibration cycle for the fast flow rate is repeated with a lower duty cycle of 55% (broadly, dispensing parameter). After turning the conveyor tube 16 at the 55% motor duty cycle for 4 seconds, the dispenser controller 62 determines 20 grains were dispensed based on the scale mass reading. The 20 grains is divided by the 4 seconds to yield 5 grains per second dispense rate. Because the 5 grains per second is within the range of 4 to 6 grains per second, 5 grains per second is stored as the fast dispense rate along with its associated motor duty cycle of 55% for use later in a dispensing cycle. The dispenser controller 62 then proceeds to perform a calibration cycle for the medium dispense rate. The conveyor tube 16 is turned at the default preset 35% motor duty cycle for 4 seconds. The dispenser controller 62 determines 10 grains was dispensed and divides the 10 grains by the 4 seconds to yield 2.5 grains per second dispense rate. Because the 2.5 grains per second is in the range of 1.5 to 3 grains per second, the 2.5 grains per second is stored as the medium dispense rate along with the associated 35% motor duty cycle (broadly, dispensing parameter) for later use in a dispensing cycle. The dispenser controller 62 then proceeds to perform a calibration cycle for the slow dispense rate. The conveyor tube 16 is turned at the default preset 18% motor duty cycle for 4 seconds. The dispenser controller 62 divides a resulting 1.6 grains by the 4 seconds to yield 0.4 grains per second dispense rate. Because the 0.4 grains per second is in the range of 0.25 to 0.5 grains per second, the 0.4 grains per second is stored as the slow dispense rate along with the associated 18% motor duty cycle (broadly, dispensing parameter). The calibration sequence is complete.

To proceed with dispensing the desired 50 grain load of powder, the user empties the powder from the tray 22 from the calibration sequence. After replacing the tray 22 on the scale 18, and entering 50 grains target mass via the user input 66, the user presses the execute actuator 96. The dispenser controller 62 proceeds to execute a dispensing sequence. Because the initial mass difference of 50 grains is greater than the 15 grain threshold, the dispenser controller 62 decides to use the fast dispense rate for the first dispensing cycle. The dispenser controller 62 calculates the amount of powder to be dispensed in the first dispensing cycle by subtracting the offset value of 1 grain from the 50 grain mass difference. The dispenser controller 62 then calculates the amount of time to turn the conveyor tube 16 (run end time) by dividing the 49 grains by the calibrated fast dispense rate of 5 grains per second, yielding a run end time of 9.8 seconds (broadly, dispensing parameter). The conveyor tube motor 34 is energized and turns at the 55% motor duty cycle determined during powder calibration. Because the duration of the dispensing cycle is greater than 0.4 seconds, the dispenser controller 62 monitors the real time dispense rate and updates the run end time as necessary. In this case, the run end time is reset several times while dispensing powder, and the conveyor tube 16 stops rotating at 9.9 seconds instead of 9.8 seconds. The calculated real time dispense rate of 4.95 grains per second used to calculate the 9.9 seconds run end time is saved to the tangible storage medium 64 as the fast dispense rate for the next dispensing cycle calling for the fast dispense rate. When the motor 34 is deenergized, 49 grains had exited the conveyor tube, but an additional 0.1 grains exited the tube before the tube ultimately stopped moving. The dispenser controller 62 waits 0.4 seconds for the scale 18 to stabilize. The current mass difference is determined to be 0.9 grains (50 grains target mass minus dispensed 49.1 grains). Because the 0.9 grains is in the range of 1.0 to 0.25 grains, the dispenser controller 62 chooses the medium dispense rate for the next dispensing cycle. The amount of powder to be dispensed in the second dispensing cycle is calculated by subtracting the offset of 0.25 grains from the 0.9 grains mass difference, yielding 0.65 grains. The 0.65 grains is divided by the calibrated medium dispense rate of 2.5 grains per second to give a 0.26 second run end time (dispensing parameter). The dispenser controller 62 then turns the conveyor tube 16 at the 35% motor duty cycle (dispensing parameter) until the run end time. The resulting mass of powder supported by the scale 18 is 49.8 grains. Because the mass difference is now 0.2 grains, in the range of 0.25 to 0.1 grains, the dispenser controller 62 chooses the slow dispense rate for the next dispensing cycle. The amount of powder to be dispensed is calculated by subtracting the offset of 0.1 grains from the 0.2 grains mass difference, yielding 0.1 grains. The 0.1 grains is divided by the calibrated slow dispense rate of 0.4 grains per second to give a 0.25 second run end time. The dispenser controller 62 then turns the conveyor tube 16 at the 18% motor duty cycle until the run end time. The resulting mass of powder supported by the scale 18 is 49.9 grains. Because the mass difference is now 0.1 grains, the dispenser controller 62 chooses trickle dispensing for the next dispensing cycle. The dispenser controller 62 turns the conveyor tube 16 for 0.018 seconds at the 18% motor duty cycle and then waits 0.4 seconds for the scale 18 to stabilize. The scale mass reading is still not equal to the target mass of 50 grains, so the dispenser controller 62 turns the conveyor tube 16 for another 0.018 seconds at the 18% motor duty cycle. Now, the mass difference is 0 because the scale mass reading is 50 grains, the same as the target mass. The dispensing sequence is complete. The user empties the powder from the tray 22 to the ammunition shell or case and replaces the tray on the scale 18.

Example 2

Assume a user would like to dispense a load of 14 grains of powder pursuant to FIGS. 8A-8E without first performing a powder calibration. The user supplies the powder to the hopper 14 and primes the conveyor tube. To proceed with dispensing the load of powder, the user enters 14 grains target mass via the user input 66, and then presses the execute actuator 96. The dispenser controller 62 proceeds to execute a dispensing sequence. Because the initial mass difference of 14 grains is less than 15 grains and greater than 6 grains, the dispenser controller 62 decides to use the medium dispense rate for the first dispensing cycle. The dispenser controller 62 calculates the amount of powder to be dispensed in the first dispensing cycle by subtracting the offset value of 0.25 grains to yield 13.75 grains. The run end time (dispensing parameter) is calculated as 4.6 seconds by dividing the 13.75 grains by the 3 grains per second preset default medium dispense rate. The conveyor tube motor 34 is energized and turns at the default preset 35% motor duty cycle until the run end time. Because the duration of the dispensing cycle is greater than 0.4 seconds, the dispenser controller 62 monitors the real time dispense rate and updates the run end time as necessary. In this case, the run end time is reset several times, and the conveyor tube 16 stops rotating at 4.9 seconds instead of 4.6 seconds. The calculated real time dispense rate of 2.8 grains per second used to calculate the 4.9 seconds run end time is saved to the tangible storage medium 64 as the medium dispense rate for the next dispensing cycle calling for the medium dispense rate. When the motor 34 is deenergized, 13.75 grains had exited the conveyor tube, but an additional 0.05 grains exited the tube before the tube ultimately stopped moving. The dispenser controller 62 waits 0.4 seconds for the scale 18 to stabilize. The current mass difference is determined to be 0.2 grains (14 grains target mass minus dispensed 13.8 grains). Because the 0.2 grains is in the range of 0.25 to 0.1 grains, the dispenser controller 62 chooses the slow dispense rate for the next dispensing cycle. The amount of powder to be dispensed in the second dispensing cycle is calculated by subtracting the offset of 0.1 grains from the 0.2 grains mass difference, yielding 0.1 grains. The 0.1 grains is divided by the preset default slow dispense rate of 0.5 grains per second to give a 0.2 second run end time (dispensing parameter). The dispenser controller 62 then turns the conveyor tube 16 at the preset default 18% motor duty cycle (dispensing parameter) until the run end time. Because the dispensing cycle is less than 0.4 seconds long, the dispenser controller 62 does not have enough time to reliably monitor the real time dispense rate, and the run end time is not dynamically updated. The resulting mass of powder supported by the scale 18 is 13.9 grains. Because the mass difference is now 0.1 grains, trickle dispensing is chosen for the next dispensing cycle. The dispenser controller 62 turns the conveyor tube 16 for 0.018 seconds at the 18% motor duty cycle and then waits 0.4 seconds for the scale 18 to stabilize. The scale mass reading is still not equal to the target mass of 14 grains, so the dispenser controller 62 turns the conveyor tube 16 for another 0.018 seconds at the 15% motor duty cycle. Now, the mass difference is 0 because the scale mass reading is 14 grains, the same as the target mass. The dispensing cycle is complete. The user empties the powder from the tray 22 to the ammunition shell or case and replaces the tray on the scale 18.

It will be understood that in use the dispenser 10 can operate in other ways than described in the examples above. For example, in some instances, no second dispensing cycle will be required because the mass difference is zero after the first dispensing cycle.

In a contemplated variation, the dispenser 10 can include an encoder arranged to read rotational position of the dispenser tube 16 such that rotation of the tube can be used as a frame of reference in carrying out steps such as explained above. In this variation, "dispense rate" can be determined as mass per unit of rotation (e.g., full 360 degree rotation) of the dispenser tube 16. Moreover, the "run end time" can be referenced as a total number of units of rotation of the conveyor tube 16. For example, instead of the controller 62 learning and using dispense rates in terms of grains per second, the controller can do so in terms of grains per unit of rotation of the conveyor tube. When the controller knows how many grains of powder are dispensed per unit of rotation, the controller can determine and implement the "run end time" in terms of a total number of units of rotation of the conveyor tube. Thus, as used herein, the term "dispense rate" can also mean mass per rotation of the conveyor tube, and the term "run end time" can also mean number of rotations at which the conveyor tube stops rotating. The algorithm and steps explained above, can be executed in terms of grains per rotation rather than grains per second without departing from the scope of the present invention. The dispenser controller 62 could count the number of rotations of the conveyor tube 16 and stop rotating the conveyor tube at the run end time, i.e., when the total number of units of conveyor tube rotation is reached. While dispensing, the controller 62 could monitor the grains per rotation dispense rate in real time, and adjust the run end time (total number of units of rotation) accordingly.

It will be appreciated that the speed at which the controller 62 operates the conveyor tube 16 during a dispensing cycle can be variable or constant without departing from the scope of the present invention.

It will be appreciated that amounts of powder can be referenced by mass or by weight without departing from the scope of the present invention. The weight of an object is a product of that object's mass because weight is mass multiplied by the force of gravity. Thus, weight is considered to be an equivalent of mass for purposes of the claimed inventions. Moreover, as used herein, the term mass is defined to mean true mass (not accounting for the force of gravity) or weight, which accounts for the force of gravity.

In view of the above, it will be appreciated that the tangible storage medium 64 stores instructions executable by the dispenser controller to perform the actions described above.

For purposes of illustration, programs and other executable program components, such as the operating system, are illustrated herein as discrete blocks. It is recognized, however, that such programs and components reside at various times in different storage components of a computing device, and are executed by one or more data processors of the device.

Embodiments of the aspects of the invention may be described in the general context of data and/or processor-executable instructions, such as program modules, stored one or more tangible, non-transitory storage media and executed by one or more processors or other devices. Generally, program modules include, but are not limited to, routines, programs, objects, components, and data structures that perform particular tasks or implement particular abstract data types. Aspects of the invention may also be practiced in distributed computing environments where tasks are performed by remote processing devices that are linked through a communications network. In a distributed computing environment, program modules may be located in both local and remote storage media including memory storage devices.

In operation, processors, computers and/or servers may execute the processor-executable instructions (e.g., software, firmware, and/or hardware) such as those illustrated herein to implement aspects of the invention.

Embodiments of the aspects of the invention may be implemented with processor-executable instructions. The processor-executable instructions may be organized into one or more processor-executable components or modules on a tangible processor readable storage medium. Aspects of the invention may be implemented with any number and organization of such components or modules. For example, aspects of the invention are not limited to the specific processor-executable instructions or the specific components or modules illustrated in the figures and described herein. Other embodiments of the aspects of the invention may include different processor-executable instructions or components having more or less functionality than illustrated and described herein.

The order of execution or performance of the operations in embodiments of the aspects of the invention illustrated and described herein is not essential, unless otherwise specified. That is, the operations may be performed in any order, unless otherwise specified, and embodiments of the aspects of the invention may include additional or fewer operations than those disclosed herein. For example, it is contemplated that executing or performing a particular operation before, contemporaneously with, or after another operation is within the scope of aspects of the invention.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the aspects of the invention are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention, including what is presently believed to be the best mode of carrying out the aspects of the invention. Additionally, it is to be understood that the aspects of the invention is not limited in its application to the details of construction and the arrangement of components set forth in the description or illustrated in the drawings. The aspects of the invention are capable of other embodiments and of being practiced or carried out in various ways. Also, it will be understood that the phraseology and terminology used herein is for the purpose of description and should not be regarded as limiting.

It will be apparent that modifications and variations are possible without departing from the scope of aspects of the invention as defined in the appended claims. It is contemplated that various changes could be made in the above constructions, products, and methods without departing from the scope of aspects of the invention. In the preceding specification, various embodiments have been described with reference to the accompanying drawings. It will, however, be evident that various modifications and changes may be made thereto, and additional embodiments may be implemented, without departing from the broader scope of the aspects of the invention as set forth in the claims that follow. The specification and drawings are accordingly to be regarded in an illustrative rather than restrictive sense.

What is claimed is:

1. A speed optimizing ammunition powder dispenser comprising:

a base configured to be supported by a support surface;

a scale supported by the base, the scale including a scale sensor, the scale sensor configured to generate a scale signal in response to powder supported by the scale;

a hopper supported by the base and configured to hold a supply of powder;

a conveyor supported by the base and configured to dispense powder from the hopper to the scale;

a powder dispenser controller configured to receive the scale signal, the powder dispenser controller being operable to control the conveyor to dispense a target amount of powder to the scale, the powder dispenser controller being operable in a default target powder dispensing mode and in a speed optimized target powder dispensing mode, the speed optimized target powder dispensing mode being different from the default target powder dispensing mode; and a non-transitory tangible storage medium coupled to the powder dispenser controller, the non-transitory tangible storage medium storing powder dispenser controller executable instructions configured to, when executed by the powder dispenser controller:

in the default target powder dispensing mode, control the conveyor to dispense the target amount of powder in a first amount of time by controlling the conveyor to move powder to the scale as a function of a preset default powder dispensing parameter; and in the speed optimized target powder dispensing mode, control the conveyor to dispense the target amount of powder in a second amount of time by automatically controlling the conveyor to move powder to the scale as a function of a powder dispensing characteristic determined by the powder dispenser controller based on the scale signal, the second amount of time being less than the first amount of time.

2. The speed optimizing ammunition powder dispenser of claim 1, wherein the preset default powder dispensing parameter is a first conveyor speed.

3. The speed optimizing ammunition powder dispenser of claim 2, wherein the non-transitory tangible storage medium includes powder dispenser controller executable instructions to, in the speed optimized target powder dispensing mode, control the conveyor to move powder to the scale as a function of a determined target powder dispensing parameter determined by the powder dispenser controller based on the powder dispensing characteristic.

4. The speed optimizing ammunition powder dispenser of claim 3, wherein the target powder dispensing parameter is a second conveyor speed faster than the first conveyor speed.

5. The speed optimizing ammunition powder dispenser of claim 3, wherein the speed optimized target powder dispensing mode comprises a target powder dispensing sequence including a fast conveyor speed dispensing cycle and a slow conveyor speed dispensing cycle, and the non-transitory tangible storage medium includes powder dispenser controller executable instructions to control the conveyor in the fast conveyor speed dispensing cycle as a function of the determined target powder dispensing parameter.

6. The speed optimizing ammunition powder dispenser of claim 5, wherein the fast conveyor speed dispensing cycle includes a start and a stop of the conveyor, and the slow conveyor speed dispensing cycle includes a start and a stop of the conveyor.

7. The speed optimizing ammunition powder dispenser of claim 5, wherein the non-transitory tangible storage medium includes powder dispenser controller executable instructions to control the conveyor in the slow conveyor speed dispensing cycle as a function of a trickle conveyor speed.

8. The speed optimizing ammunition powder dispenser of claim 1, wherein controlling the conveyor to move powder to the scale as a function of the powder dispensing characteristic comprises controlling the conveyor as a function of a determined powder dispensing parameter determined automatically by the powder dispenser controller based on the powder dispensing characteristic.

9. The speed optimizing ammunition powder dispenser of claim 8, wherein the non-transitory tangible storage medium includes powder dispenser controller executable instructions to, in the speed optimized target powder dispensing mode, dispense powder in a target powder dispensing sequence including a fast conveyor speed dispensing cycle and a slow conveyor speed dispensing cycle, and to control the conveyor in the fast conveyor speed dispensing cycle as a function of the determined target powder dispensing parameter.

10. The speed optimizing ammunition powder dispenser of claim 1, wherein the non-transitory tangible storage medium includes powder dispenser controller executable instructions to perform a powder calibration to calibrate the speed optimizing ammunition powder dispenser to the powder, the powder dispensing characteristic determined by the powder dispenser controller based on the powder calibration.

11. The speed optimizing ammunition powder dispenser of claim 10, wherein the powder calibration includes a powder calibration sequence comprising a first powder calibration dispensing cycle and a second powder calibration dispensing cycle, the first powder calibration dispensing cycle including operating the conveyor at a first conveyor speed to dispense powder, the second powder calibration dispensing cycle including operating the conveyor at a second conveyor speed to dispense powder, the second conveyor speed being different from the first conveyor speed.

12. The speed optimizing ammunition powder dispenser of claim 1, further comprising a user interface configured to receive input from a user indicative of a desired target amount of powder to be dispensed, and wherein the non-transitory tangible storage medium includes powder dispenser controller executable instructions to, in the speed optimized target powder dispensing mode, control the conveyor to move powder from the hopper to the scale as a function of the input from the user to dispense the target amount of powder.

13. The speed optimizing ammunition powder dispenser of claim 1, further comprising a user interface configured to receive input from a user, the user interface including an execute actuator, the powder dispenser controller being responsive to the execute actuator to begin dispensing the target amount of powder in the speed optimized target powder dispensing mode.

14. The speed optimizing ammunition powder dispenser of claim 1, wherein the powder dispensing characteristic is a powder dispensing rate.

* * * * *